US012410032B2

(12) United States Patent
Katsumata et al.

(10) Patent No.: US 12,410,032 B2
(45) Date of Patent: Sep. 9, 2025

(54) SHEET BINDING APPARATUS, SHEET PROCESSING APPARATUS, AND IMAGE FORMING SYSTEM

(71) Applicant: CANON FINETECH NISCA INC., Saitama (JP)

(72) Inventors: Toshiyuki Katsumata, Yamanashi (JP); Junya Nakajima, Yamanashi (JP); Masaya Takahashi, Yamanashi (JP); Mamoru Kubo, Yamanashi (JP)

(73) Assignee: Canon Finetech Nisca Inc., Saitama (JP)

( * ) Notice: Subject to any disclaimer, the term of this patent is extended or adjusted under 35 U.S.C. 154(b) by 82 days.

(21) Appl. No.: 18/354,036

(22) Filed: Jul. 18, 2023

(65) Prior Publication Data

US 2024/0025692 A1 Jan. 25, 2024

(30) Foreign Application Priority Data

Jul. 25, 2022 (JP) ..... 2022-117885
Jul. 10, 2023 (JP) ..... 2023-113320

(51) Int. Cl.
*B65H 37/04* (2006.01)
*B65H 31/02* (2006.01)

(52) U.S. Cl.
CPC ..... *B65H 37/04* (2013.01); *B65H 31/02* (2013.01); *B65H 2301/4213* (2013.01); *B65H 2301/51611* (2013.01); *B65H 2404/743* (2013.01)

(58) Field of Classification Search
CPC .... B65H 2301/51611; B65H 2404/743; B65H 31/02; B65H 37/04; B65H 2301/4213; B65H 2801/27
See application file for complete search history.

(56) References Cited

U.S. PATENT DOCUMENTS 7,654,511 B2 2/2010 Nagata et al.
2018/0348692 A1* 12/2018 Yoshida ..... B65H 37/04
2022/0204302 A1* 6/2022 Nishi ..... B65H 31/34

FOREIGN PATENT DOCUMENTS

JP 2006-248685 A 9/2006
JP 2014-061964 A 4/2014
WO WO-2021188175 A1 * 9/2021

* cited by examiner

*Primary Examiner* — Jennifer Bahls
(74) *Attorney, Agent, or Firm* — Venable LLP

(57) ABSTRACT

A guide portion guides a binding unit in a first direction and a second direction. The guide portion includes a pair of first wall portions, a pair of second wall portions, a pair of third wall portions, and a restricting portion. A first protrusion is engageable between the pair of first wall portions and between the pair of second wall portions. A second protrusion is disposed upstream of the first protrusion in the first direction, and is engageable with the pair of first wall portions and the pair of third wall portions. The restricting portion restricts entry of the first protrusion from between the pair of first wall portions to between the pair of third wall portions and permits entry of the second protrusion from between the pair of first wall portions to between the pair of third wall portions.

3 Claims, 19 Drawing Sheets

F-SIDE
R-SIDE
436
438
432
433
430
431
γ1
γ2
413
434c
435
434

450

464
463
437

SHEET BINDING APPARATUS, SHEET PROCESSING APPARATUS, AND IMAGE FORMING SYSTEM

BACKGROUND OF THE INVENTION

Field of the Invention

The present invention relates to a sheet binding apparatus that performs a binding process on sheets, a sheet processing apparatus including the sheet binding apparatus, and an image forming system including the sheet processing apparatus.

Description of the Related Art

As a sheet processing apparatus, a configuration including a sheet binding apparatus having a binding unit such as a staple unit that performs a binding process on sheets is conventionally known. In addition, as such a sheet binding apparatus, a configuration in which a staple unit is moved along a width direction of a sheet to perform a side stitch binding in which a binding process is performed in parallel to the width direction with respect to an edge portion of the sheet and an oblique binding in which a binding process is performed in a direction inclined in the width direction with respect to a corner portion of the sheet is conventionally known.

As a mechanism for moving the staple unit in the width direction, for example, JP 2014-61964 A discloses a configuration in which a groove is formed in a moving table for moving the staple unit, and two protrusions provided on the staple unit side are engaged with the groove to guide the staple unit. In the case of the configuration described in JP 2014-61964 A, the mechanism includes a main body groove formed along the width direction, a branch groove branched from the main body groove on the end side in the width direction of the main body groove, and an extension groove further formed along the main body groove from a branch point. Further, when the oblique binding is performed on the corner portion of the sheet, the oblique binding can be executed by inclining the staple unit by guiding one protrusion on the downstream side in the moving direction of the staple unit to the branch groove and the other protrusion on the upstream side to the extension groove, of the two protrusions on the staple unit side.

Here, in order to engage the protrusion on the downstream side with the branch groove in order to perform the oblique binding, normally, a turning assisting member serving as a trigger for turning the staple unit with the movement of the staple unit is required. As the turning assisting member, for example, there is a configuration in which the turning assisting member provided outside the groove and the staple unit is turned by being brought into contact with a part of a member moving together with the staple unit.

It is desired to further improve a configuration in which a binding unit such as a staple unit is turned when oblique binding is performed.

SUMMARY OF THE INVENTION

According to a first aspect of the present invention, a sheet binding apparatus includes a binding unit configured to move in a first direction and a second direction opposite to the first direction and perform a binding process on sheets, a guide portion configured to guide the binding unit in the first direction and the second direction, a moving portion configured to move along the guide portion together with the binding unit, a rotation holding portion configured to rotatably hold the binding unit with respect to the moving portion, an engaging portion that is provided to be movable in the first direction and the second direction together with the binding unit and to be rotatable together with the binding unit, the engaging portion including a first protrusion and a second protrusion each engaged with the guide portion, and, a driving unit configured to drive the moving portion to move the moving portion along the guide portion. The guide portion includes a pair of first wall portions formed along the first direction, a pair of second wall portions formed along an inclined direction inclined with respect to the first direction from a downstream end of the first wall portion in the first direction, a pair of third wall portions formed along the first direction from a downstream end of the first wall portion in the first direction, and a restricting portion. The pair of first wall portions is disposed so as to guide the first protrusion and the second protrusion movably along the first direction in a state where the first protrusion and the second protrusion are disposed between the pair of first wall portions. The pair of the second wall portions is disposed so as to guide the first protrusion movably along the inclined direction in a state where the first protrusion is disposed between the pair of second wall portions. The pair of the third wall portions is disposed so as to guide the second protrusion movably along the first direction from the downstream end of the first wall portion in the first direction in a state where the second protrusion is disposed between the pair of third wall portions. The first protrusion is engageable between the pair of first wall portions and between the pair of second wall portions by a first engagement amount in a height direction of the first wall portions and the second wall portions. The second protrusion is disposed upstream of the first protrusion in the first direction, and is engageable between the pair of first wall portions and between the pair of third wall portions by a second engagement amount smaller than the first engagement amount in the height direction of the first wall portions and the third wall portions. The restricting portion is configured to restrict entry of the first protrusion from between the pair of first wall portions to between the pair of third wall portions and permit entry of the second protrusion from between the pair of first wall portions to between the pair of third wall portions.

According to a second aspect of the present invention, a sheet processing apparatus includes a first conveyance portion configured to convey a sheet in a first conveyance direction, a placement portion configured to place the sheet conveyed to a downstream side in the first conveyance direction by the first conveyance portion, a second conveyance portion configured to convey the sheet on the placement portion in a second conveyance direction opposite to the first conveyance direction, an abutment portion against which a downstream end edge in the second conveyance direction of the sheet conveyed in the second conveyance direction by the second conveyance portion abuts, and, a sheet binding apparatus configured to perform a binding process on the sheet which is conveyed in the second conveyance direction by the second conveyance portion and of which the downstream end edge in the second conveyance direction is abutted against the abutment portion. The sheet binding apparatus includes a binding unit configured to move in a first direction and a second direction opposite to the first direction and perform a binding process on sheets, a guide portion configured to guide the binding unit in the first direction and the second direction, a moving portion configured to move along the guide portion together with the binding unit, a rotation holding portion configured to rotatably hold the binding unit with respect to the moving portion, an engaging portion that is provided to be movable in the first direction and the second direction together with the binding unit and to be rotatable together with the binding unit, the engaging portion including a first protrusion and a second protrusion each engaged with the guide portion, and, a driving unit configured to drive the moving portion to move the moving portion along the guide portion. The guide portion includes a pair of first wall portions formed along the first direction, a pair of second wall portions formed along an inclined direction inclined with respect to the first direction from a downstream end of the first wall portion in the first direction, a pair of third wall portions formed along the first direction from a downstream end of the first wall portion in the first direction, and a restricting portion. The pair of first wall portions is disposed so as to guide the first protrusion and the second protrusion movably along the first direction in a state where the first protrusion and the second protrusion are disposed between the pair of first wall portions. The pair of the second wall portions is disposed so as to guide the first protrusion movably along the inclined direction in a state where the first protrusion is disposed between the pair of second wall portions. The pair of the third wall portions is disposed so as to guide the second protrusion movably along the first direction from the downstream end of the first wall portion in the first direction in a state where the second protrusion is disposed between the pair of third wall portions. The first protrusion is engageable between the pair of first wall portions and between the pair of second wall portions by a first engagement amount in a height direction of the first wall portions and the second wall portions. The second protrusion is disposed upstream of the first protrusion in the first direction, and is engageable between the pair of first wall portions and between the pair of third wall portions by a second engagement amount smaller than the first engagement amount in the height direction of the first wall portions and the third wall portions. The restricting portion is configured to restrict entry of the first protrusion from between the pair of first wall portions to between the pair of third wall portions and permit entry of the second protrusion from between the pair of first wall portions to between the pair of third wall portions. By moving along the guide portion by the driving unit, the binding unit is capable of performing a first binding process of binding a downstream edge portion of the sheets in the second conveyance direction in a direction along a width direction of the sheet intersecting the second conveyance direction and a second binding process of binding a corner portion of the downstream edge portion of the sheets in the second conveyance direction on one end side of the sheet in the width direction in a direction inclined with respect to the width direction.

According to a third aspect of the present invention, an image forming system includes an image forming apparatus including an image forming unit configured to form an image on a sheet, and a sheet processing apparatus configured to perform a binding process on a sheet on which an image is formed by the image forming unit. The sheet processing apparatus includes a first conveyance portion configured to convey a sheet in a first conveyance direction, a placement portion configured to place the sheet conveyed to a downstream side in the first conveyance direction by the first conveyance portion, a second conveyance portion configured to convey the sheet on the placement portion in a second conveyance direction opposite to the first conveyance direction, an abutment portion against which a downstream end edge in the second conveyance direction of the sheet conveyed in the second conveyance direction by the second conveyance portion abuts, and, a sheet binding apparatus configured to perform a binding process on the sheet which is conveyed in the second conveyance direction by the second conveyance portion and of which the downstream end edge in the second conveyance direction is abutted against the abutment portion. The sheet binding apparatus includes a binding unit configured to move in a first direction and a second direction opposite to the first direction and performs a binding process on sheets, a guide portion configured to guide the binding unit in the first direction and the second direction, a moving portion configured to move along the guide portion together with the binding unit, a rotation holding portion configured to rotatably hold the binding unit with respect to the moving portion, an engaging portion that is provided to be movable in the first direction and the second direction together with the binding unit and to be rotatable together with the binding unit, the engaging portion including a first protrusion and a second protrusion engaged with the guide portion, and, a driving unit configured to drive the moving portion to move the moving portion along the guide portion. The guide portion includes a pair of first wall portions formed along the first direction, a pair of second wall portions formed along an inclined direction inclined with respect to the first direction from a downstream end of the first wall portion in the first direction, a pair of third wall portions formed along the first direction from a downstream end of the first wall portion in the first direction, and a restricting portion. The pair of first wall portions is disposed so as to guide the first protrusion and the second protrusion movably along the first direction in a state where the first protrusion and the second protrusion are disposed between the pair of first wall portions. The pair of the second wall portions is disposed so as to guide the first protrusion movably along the inclined direction in a state where the first protrusion is disposed between the pair of second wall portions. The pair of the third wall portions is disposed so as to guide the second protrusion movably along the first direction from the downstream end of the first wall portion in the first direction in a state where the second protrusion is disposed between the pair of third wall portions. The first protrusion is engageable between the pair of first wall portions and between the pair of second wall portions by a first engagement amount in a height direction of the first wall portions and the second wall portions. The second protrusion is disposed upstream of the first protrusion in the first direction, and is engageable between the pair of first wall portions and between the pair of third wall portions by a second engagement amount smaller than the first engagement amount in the height direction of the first wall portions and the third wall portions. The restricting portion is configured to restrict entry of the first protrusion from between the pair of first wall portions to between the pair of third wall portions and permit entry of the second protrusion from between the pair of first wall portions to between the pair of third wall portions. By moving along the guide portion by the driving unit, the binding unit is capable of performing a first binding process of binding a downstream edge portion of the sheets in the second conveyance direction in a direction along a width direction of the sheet intersecting the second conveyance direction and a second binding process of binding a corner portion of the downstream edge portion of the sheets in the second conveyance direction on one end side of the sheet in the width direction in a direction inclined with respect to the width direction.

Further features of the present invention will become apparent from the following description of exemplary embodiments with reference to the attached drawings.

DESCRIPTION OF THE EMBODIMENTS

An embodiment will be described with reference to FIGS. 1 to 19C. First, a schematic configuration of an image forming system according to the present embodiment will be described with reference to FIG. 1. Note that, in the following description, a front side (F side) is a side on which the user operates the apparatus, that is, a front side of the apparatus, and is, for example, a side on which an operation unit such as a button or an operation panel for operating the image forming system is provided. A rear side (R side) is a side opposite to the front side in the width direction of the sheet to be described below, that is, a back side of the apparatus.

Image Forming System

Figure 1:
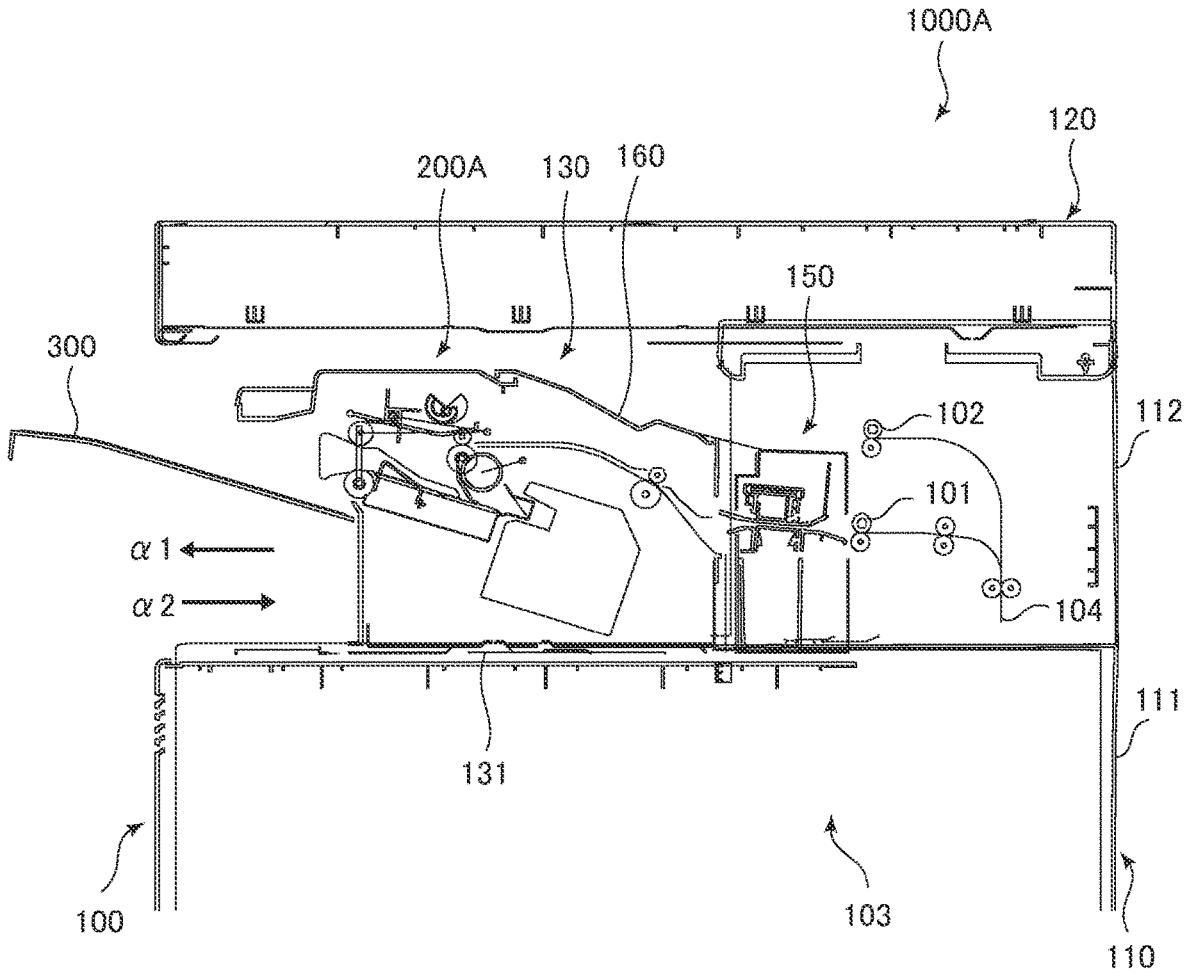
FIG. 1 is a schematic configuration cross-sectional view of an image forming system according to an embodiment.

FIG. 1 is a cross-sectional view illustrating the schematic configuration of the image forming system according to the present embodiment. An image forming system 1000A includes an image forming apparatus 100, a punch unit 150, and a sheet processing apparatus 200A. The image forming apparatus 100 is a copying machine, a printer, a facsimile, a multifunction peripheral having a plurality of functions thereof, or the like, and forms an image on a sheet such as a sheet of paper or a plastic sheet. In the present embodiment, an electrophotographic system printer is used, and a sheet on which a toner image is formed is discharged from a first discharge portion 101 or a second discharge portion 102. The image forming apparatus 100 may be an inkjet type image forming apparatus.

In the image forming apparatus of the present embodiment, although not illustrated in detail, a toner image is formed on a sheet in the image forming unit 103. Briefly, a surface of a photosensitive drum is charged and exposed to form an electrostatic latent image on the photosensitive drum. Then, the electrostatic latent image is developed with a developer by a developing unit to form a toner image. The toner image formed on the photosensitive drum is transferred to a sheet, and further heated and pressed by a fixing unit to be fixed to the sheet. The sheet on which the toner image is fixed is sent to the first discharge portion 101 or the second discharge portion 102 through a conveyance path 104.

The image forming apparatus 100 of the present embodiment includes an image forming apparatus body 110 including the image forming unit 103, the conveyance path 104, the first discharge portion 101, and the second discharge portion 102, and an image reading unit 120 disposed above the image forming apparatus body 110. The image reading unit 120 reads an image on a document and sends a read image signal to the image forming apparatus body 110. The image forming apparatus body 110 includes a first casing unit 111 in which the image forming unit 103 is disposed, and a second casing unit 112 in which a part of the conveyance path 104, the first discharge portion 101, and the second discharge portion 102 are disposed, and the second casing unit 112 is provided above the first casing unit 111. The image reading unit 120 is provided above the second casing unit 112. In addition, an operation panel (not illustrated) is provided in the second casing unit, and an instruction (printing condition, mode setting, and the like) from the user can be input to the image forming apparatus 100, the punch unit 150, and the sheet processing apparatus 200A.

In the present embodiment, with such a configuration, an in-body space 130 surrounded by the first casing unit 111, the second casing unit 112, and the image reading unit 120 is provided. Then, the sheet is discharged from the first discharge portion 101 or the second discharge portion 102 into the in-body space 130. The punch unit 150, the sheet processing apparatus 200A, and the like are detachable from the in-body space 130. In the present embodiment, the image forming system 1000A is configured by attaching the punch unit 150 and the sheet processing apparatus 200A, but any one of the punch unit 150 and the sheet processing apparatus 200A or another apparatus that performs sheet processing may be attached.

The punch unit 150 is connected to the first discharge portion 101, and can receive a sheet discharged from the first discharge portion 101 and perform punch processing on the sheet. The sheet processing apparatus 200A is connected to a sheet discharge portion of the punch unit 150 and receives the sheet discharged from the punch unit 150. As will be described in detail below, predetermined processing such as stapling can be performed on the sheet. It is possible to deliver the sheet to the sheet processing apparatus 200A without performing punch processing by the punch unit 150, and it is also possible to discharge the sheet without performing predetermined processing in the sheet processing apparatus 200A. The sheet discharged from the second discharge portion 102 is discharged to a sheet placement surface 160 above the punch unit 150 and the sheet processing apparatus 200A.

In the in-body space 130, a rail 131 is disposed along a left-right direction in FIG. 1, and the punch unit 150 and the sheet processing apparatus 200A are detachable in directions of arrows $\alpha 1$ and $\alpha 2$ along the rail 131. The punch unit 150 may be omitted, and the sheet processing apparatus 200A may be directly connected to the first discharge portion 101. Further, by making the punch unit 150 and the sheet processing apparatus 200A detachable in this manner, sheet jam processing can be performed.

For example, when the sheet is jammed in the first discharge portion 101, the punch unit 150 and the sheet processing apparatus 200A are pulled out in the direction of the arrow $\alpha 1$ to expose the first discharge portion 101. When the sheet is jammed in the punch unit 150, only the sheet processing apparatus 200A is pulled out in the direction of the arrow $\alpha 1$ to expose the punch unit 150. When the punch unit 150 and the sheet processing apparatus 200A are attached to the image forming apparatus 100, the punch unit 150 and the sheet processing apparatus 200A are pushed in the direction of the arrow $\alpha 2$. As described above, in the present embodiment, since the sheet processing apparatus 200A is disposed in the in-body space 130 of the image forming apparatus 100, it is required to reduce the size of the sheet processing apparatus 200A.

Sheet Processing Apparatus

Figure 2:
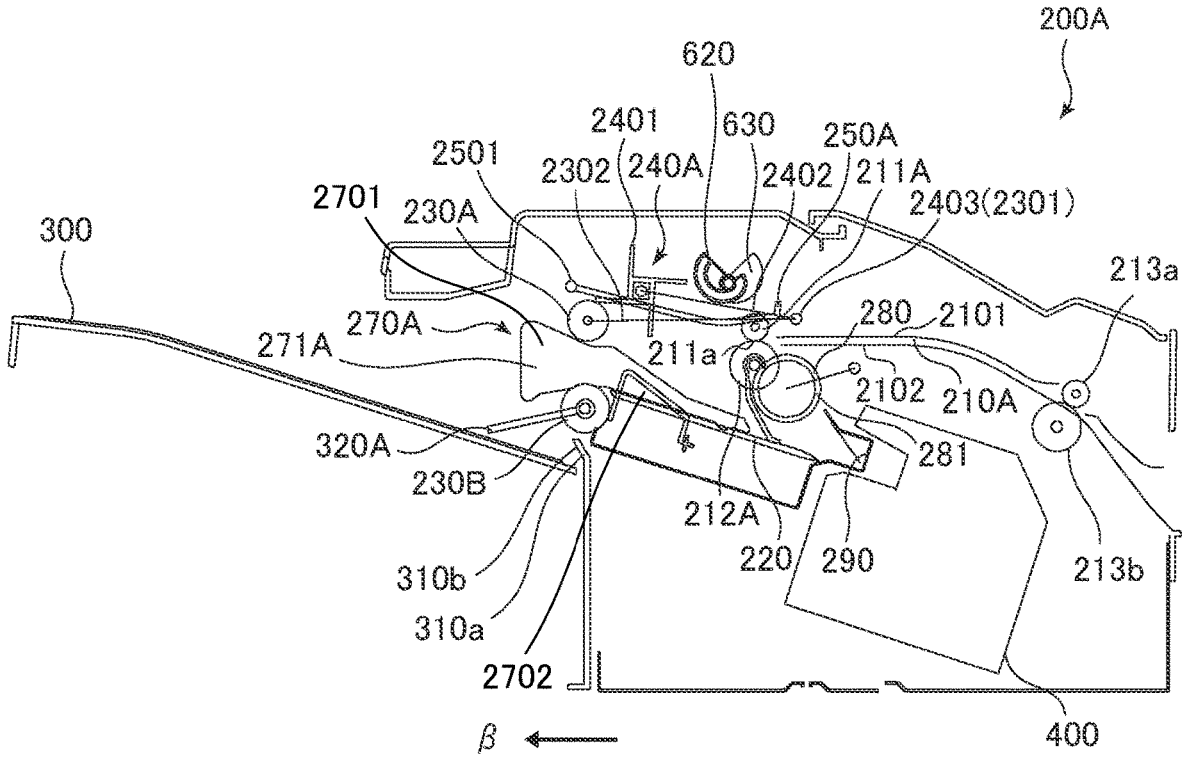
FIG. 2 is a schematic configuration cross-sectional view of a sheet processing apparatus according to the embodiment.
Figure 3:
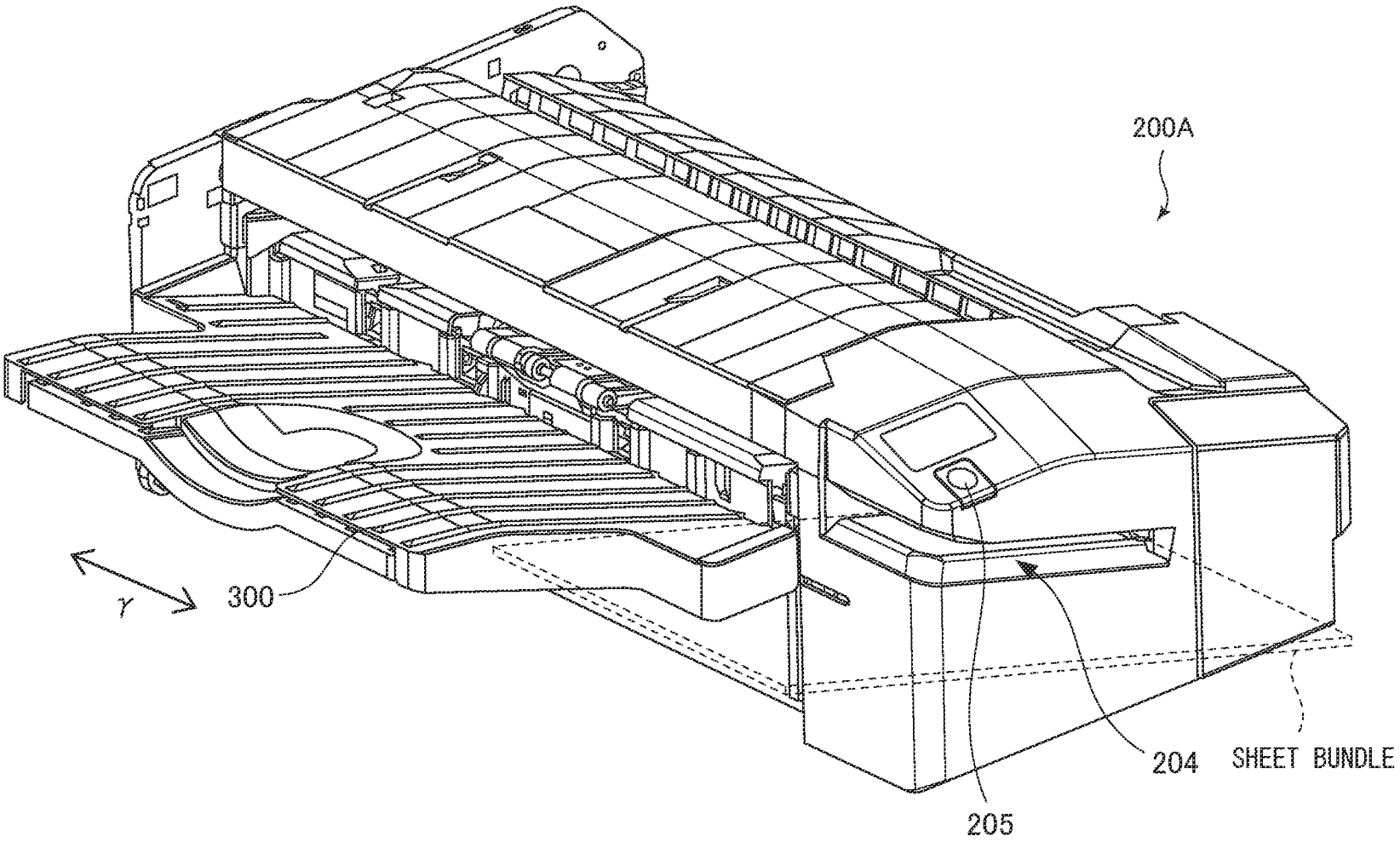
FIG. 3 is a perspective view of the sheet processing apparatus according to the embodiment.

A configuration of a sheet processing apparatus 200A of the present embodiment will be described with reference to FIGS. 2 and 3. The sheet processing apparatus 200A includes a conveyance path 210A, pre-processing rollers 211A and 212A serving as a first conveyance portion, a processing tray 220 serving as a placement portion, an upper discharge roller (i.e., nip member) 230A and a lower discharge roller 230B serving as a pair of discharge rotary members (i.e., discharge portions), a reversing paddle 240A serving as a second conveyance portion, a trailing edge dropping member 250A serving as a sheet dropping portion, an alignment unit 270A serving as a shift unit, a return member 280, a trailing edge regulation member 290 serving as an abutment portion, a stacking tray 300 serving as a stacking portion, a sheet pressing paddle 320A, and the like. The sheet received from the image forming apparatus 100 or the punch unit 150 is conveyed to the conveyance path 210A.

The sheet conveyed from the conveyance path 210A is directly discharged to the stacking tray 300 or placed on the processing tray 220 according to the mode of processing the sheet. The direct discharge to the stacking tray 300 means that the sheet is discharged to the stacking tray 300 without being reversely conveyed to a position where staple processing can be executed with the sheet on the processing tray 220. In other words, the sheet processing apparatus 200A has a mode of discharging the sheets on which the staple processing is performed by the staple unit 400 to the stacking tray 300 and a mode of discharging the sheets to the stacking tray 300 without performing the staple processing by the staple unit 400. In the present embodiment, the sheet can be aligned by the alignment unit 270A without being placed on the processing tray 220. Further, the sheet can be also aligned on the processing tray 220, and the staple unit 400 can staple the sheets placed on the processing tray 220. Further, the sheet or a sheet bundle placed on the processing tray 220 can be discharged to the stacking tray 300 by the upper discharge roller 230A and the lower discharge roller 230B serving as the pair of discharge rotary members, and the like. Hereinafter, a configuration of each unit will be described in detail.

Conveyance Path

The conveyance path 210A is a path that conveys a sheet in a first conveyance direction (predetermined direction), and includes an upper guide 2101 that guides an upper surface of the conveyed sheet and a lower guide 2102 that guides a lower surface of the sheet. In the conveyance path 210A, the pre-processing rollers 211A and 212A serving as the first conveyance portion (the pair of conveyance rotary members), and upstream rollers (inlet rollers) 213*a* and 213*b* are disposed. These are disposed in pairs so as to be separated from each other in a width direction of the sheet (direction of arrow γ in FIG. 3) intersecting a conveyance direction of the sheet (first conveyance direction, direction of arrow β in FIG. 2 (left-right direction)), respectively.

The pre-processing rollers 211A and 212A are a first conveyance portion and the pair of conveyance rotary members that convey a sheet, and at least one of the pre-processing rollers 211A and 212A rotates while nipping the sheet. At least one of the upstream rollers 213*a* and 213*b* rotates while nipping the sheet. The upstream rollers 213*a* and 213*b* are disposed at an inlet of the sheet processing apparatus 200A, and receive a sheet conveyed from upstream of the sheet processing apparatus 200A and convey the sheet to the conveyance path 210A. Then, the sheet passing through the conveyance path 210A reaches the pre-processing rollers 211A and 212A.

The pre-processing rollers 211A and 212A form a pre-processing nip portion 211*a* capable of nipping and conveying a sheet. Then, the sheet is nipped by the pre-processing nip portion 211*a* and conveyed in the first conveyance direction, and the sheet is discharged from the conveyance path 210A. The pre-processing rollers 211A and 212A can be brought into contact with or separated from each other, or the nip pressure can be changed.

Processing Tray

The processing tray 220 serving as the placement portion is disposed on a downstream side in a sheet conveyance direction (first conveyance direction) of the conveyance path 210A and vertically below the conveyance path 210A. The processing tray 220 is inclined with respect to a horizontal plane such that an upstream side in the first conveyance direction is lower than the downstream side in the first conveyance direction. The processing tray 220 temporarily places the sheet conveyed to the downstream side in the first conveyance direction by the pre-processing rollers 211A and 212A. In addition, the processing tray 220 can stack a plurality of sheets in an overlapping manner, and alignment of the sheets in the width direction and movement of the sheets in the width direction (shift of the sheets) are performed by the alignment unit 270A with the sheets on the processing tray 220. The trailing edge regulation member 290 serving as the abutment portion against which an upstream end edge (a downstream end edge in a second conveyance direction opposite to the first conveyance direction, and a trailing edge of the sheet) of the sheet placed on the processing tray 220 in the first conveyance direction abuts is disposed at an upstream end of the processing tray 220 in the first conveyance direction. A part of the processing tray 220 (for example, the downstream side end portion in the first conveyance direction) may protrude vertically above the conveyance path 210A.

Further, the staple unit 400 serving as a binding unit performing a binding process on the sheets is disposed upstream of the processing tray 220 in the first conveyance direction. The staple unit 400 performs staple processing (binding processing) as predetermined processing on the sheet bundle subjected to the alignment in the width direction and regulation of the trailing edge by the processing tray 220. The staple unit 400 configures a part of a sheet binding apparatus 410 as described below, is configured to change a staple position with respect to the sheet bundle and to move according to the staple position. The predetermined processing may be other processing such as punching other than stapling. The sheet or the sheet bundle placed on the processing tray 220 are discharged to the stacking tray 300 by the upper discharge roller 230A and the lower discharge roller 230B as described below.

Reversing Paddle

The reversing paddle 240A serving as the second conveyance portion conveys the sheet on the processing tray 220 in the second conveyance direction opposite to the first conveyance direction. The reversing paddle 240A includes a paddle portion 2401 serving as a rotary member, a paddle arm 2402 serving as a supporting portion that supports the paddle portion 2401, and a swing fulcrum 2403 that swingably supports the paddle arm 2402. That is, the paddle arm 2402 is swingable in a vertical direction about the swing fulcrum 2403, and the paddle portion 2401 is rotatably provided at the distal end of the paddle arm 2402.

The reversing paddle 240A is swingable about the swing fulcrum 2403 between a return position where the paddle portion 2401 abuts on the upper surface of the sheet on the processing tray 220 to convey the sheet in the second conveyance direction and an upper retracting position where the paddle portion 2401 is retracted above the return position. The swing fulcrum 2403 is disposed upstream of the pre-processing nip portion 211*a*, which is a nip position at which the sheet is nipped by the pre-processing rollers 212A and 211A, in the first conveyance direction and vertically above the pre-processing nip portion 211*a*. The paddle arm 2402 extends from the swing fulcrum 2403 toward the downstream side in the first conveyance direction, and the paddle portion 2401 is provided at a distal end portion thereof. A pair of the reversing paddles 240A is disposed on both sides in the width direction of the upper discharge roller 230A to be described below.

Trailing Edge Dropping Member

A pair of the trailing edge dropping members 250A serving as the sheet dropping portion is provided on both sides of the pair of reversing paddles 240A. That is, the pair of the trailing edge dropping members 250A is disposed on both sides of the reversing paddle 240A in the width direction, and moves in the vertical direction in conjunction with the reversing paddle 240A as described below, so that the pair of the trailing edge dropping members 250A operates to abut on the upper surface of the sheet on the upstream side in the first conveyance direction and to drop the upstream end portion (trailing edge portion) of the sheet toward the processing tray 220. The trailing edge dropping member 250A may be operated by a separate drive from the reversing paddle 240A.

The trailing edge dropping member 250A includes a pivot shaft 2501 serving as the pivot axis downstream of the pre-processing rollers 211A and 212A serving as the pair of conveyance rollers in the first conveyance direction. The trailing edge dropping member 250A extends to the upstream side in the first conveyance direction from the pivot shaft 2501, and is pivotable about the pivot shaft 2501 from an upper position above the pre-processing rollers 211A and 212A to a lower position below the pre-processing rollers 211A and 212A. The trailing edge dropping member 250A pivots from the upper position to the lower position, and thus, abuts on the sheet conveyed by the pre-processing rollers 211A and 212A from above and drops the sheet onto the processing tray 220 below.

Return Member

The return member 280 conveys the sheet conveyed toward the trailing edge regulation member 290 by the reversing paddle 240A as described above, further toward the trailing edge regulation member 290, and brings the trailing edge of the sheet into contact with the trailing edge regulation member 290 to regulate the trailing edge position of the sheet. The return member 280 is configured by a knurled belt 281, and rotationally drives the knurled belt 281 to further convey the sheet conveyed to the upstream side in the first conveyance direction by the reversing paddle 240A, thereby bringing the trailing edge into contact with the trailing edge regulation member 290. The return member 280 is movable to an abutting position where the return member 280 can abut on the sheet and a retracting position where the return member 280 is retracted above the abutting position, and moves to the abutting position when the sheet is conveyed toward the trailing edge regulation member 290 and to the retracting position when the sheet on the processing tray 220 is conveyed toward the stacking tray 300.

Discharge Roller

The upper discharge roller 230A and the lower discharge roller 230B configure the pair of discharge rotary members and the discharge portion, convey the sheet conveyed to the downstream side in the first conveyance direction by the pre-processing rollers 211A and 212A to the downstream side in the first conveyance direction with respect to the processing tray 220, and discharge the sheet. Specifically, the upper discharge roller 230A and the lower discharge roller 230B discharge the sheets stapled by the staple unit 400 onto the stacking tray 300. The upper discharge roller 230A is movable to a nip position (contact position) where the sheet is nipped between the upper discharge roller 230A and the lower discharge roller 230B and a retracting position where the upper discharge roller 230A is retracted above the nip position, and nips the sheet between the upper discharge roller 230A and the lower discharge roller 230B at the nip position. That is, the upper discharge roller 230A functions as a nip member that nips the sheet between the upper discharge roller 230A and the lower discharge roller 230B at the nip position. Two upper discharge rollers 230A are disposed apart from each other in the width direction of the sheet. Two lower discharge rollers 230B are disposed apart from each other in the width direction of the sheet. In the present embodiment, the upper discharge rollers 230A and the lower discharge rollers 230B are disposed inside the pair of reversing paddles 240A in the width direction.

The upper discharge roller 230A and the lower discharge roller 230B nip the sheet or the sheet bundle at the nip position, and for example, the lower discharge roller 230B rotates to convey the nipped sheet or sheet bundle. The upper discharge roller 230A is a driven roller that rotates following the rotation of the lower discharge roller 230B, but may be configured to drive. That is, in the present embodiment, the upper discharge roller 230A is the driven rotary member, and the lower discharge roller 230B is the driving rotary member. Further, the upper discharge roller 230A functions as a nip member capable of nipping the sheet with the lower discharge roller 230B at the nip position, but the nip member may be another rotary member such as a belt instead of the roller, or may be an abutting member that abuts on the sheet without rotating like a lever member. Further, the lower discharge roller 230B may be a rotary member such as a belt in addition to the roller.

The upper discharge roller 230A is pivotable about the pivot shaft 2301 between the nip position and the retracting position. In other words, the upper discharge roller 230A is movable up and down between the nip position and the retracting position. The upper discharge roller 230A is provided at a distal end of the discharge arm 2302 serving as a supporting portion. The pivot shaft 2301 is provided coaxially with the swing fulcrum 2403 described above, and is disposed upstream in the first conveyance direction from the pre-processing nip portion 211*a* that nips the sheet with the pre-processing rollers 211A and 212A, and vertically above the pre-processing nip portion 211*a*. Then, the discharge arm 2302 extends from the pivot shaft 2301 to the downstream side in the first conveyance direction, and the upper discharge roller 230A is provided at a distal end portion thereof. The pivot shaft 2301 may not be disposed coaxially with the swing fulcrum 2403, but in the present embodiment, the pivot shafts of the upper discharge roller 230A and the reversing paddle 240A are coaxial.

The pivot shaft 2301 is disposed on the upstream side in the first conveyance direction with respect to a discharge nip portion where the upper discharge roller 230A nips the sheet with the lower discharge roller 230B at the nip position. Further, the upper discharge roller 230A is positioned vertically above the pre-processing nip portion 211*a* that nips the sheet with the pre-processing rollers 211A and 212A in the retracting position, and the pivot shaft 2301 is positioned vertically above the center of the upper discharge roller 230A in the retracting position.

Since the positional relationship between the pivot shaft 2301 and the pre-processing nip portion 211*a* is defined as described above, the upper discharge roller 230A allows the sheet passing through the pre-processing nip portion 211*a* to move toward the stacking tray 300 in the state of being in the retracting position. On the other hand, the upper discharge roller 230A rotates counterclockwise in FIG. 2 about the pivot shaft 2301, thereby moving downward from the retracting position toward the nip position. When the upper discharge roller 230A moves to the nip position, the sheet can be nipped between the upper discharge roller 230A and the lower discharge roller 230B.

Alignment Unit

The alignment unit 270A serving as a shift unit moves in a shift direction (width direction) intersecting the first conveyance direction in a state of being in contact with an end edge along the first conveyance direction of the sheet conveyed to the downstream side in the first conveyance direction by the pre-processing rollers 211A and 212A, thereby moving the sheet in the shift direction. Such an alignment unit 270A includes a pair of aligning plates 271A disposed to face each other in the shift direction.

The pair of aligning plates 271A is disposed further downstream of the downstream end portion in the first conveyance direction of the conveyance path 210A, and moves in the width direction to abut on the end edge in the width direction of the sheet, thereby performing the alignment of the sheet in the width direction. In the present embodiment, the aligning plates 271A are disposed on both sides in the width direction of the sheet placed on the processing tray 220, and are movable in the width direction, respectively. The pair of aligning plates 271A extends from the upstream side to the downstream side in the first conveyance direction with respect to the upper discharge roller 230A and the lower discharge roller 230B. The configuration of the pair of aligning plates 271A is the same. The pair of aligning plates 271A moves in the shift direction by the driving of a front side (F side) aligning plate moving motor and a rear side (R side) aligning plate moving motor serving as driving units.

The aligning plate 271A is formed to have a large width in the vertical direction on the downstream side in the first conveyance direction. That is, the aligning plate 271A includes a first plate portion 2701 on the downstream side in the first conveyance direction and a second plate portion 2702 formed to be continuous with the first plate portion 2701 on the upstream side in the first conveyance direction. The first plate portion 2701 has a larger area in the vertical direction than the second plate portion 2702 so as to be able to abut on the conveyed sheet even if the leading edge side of the sheet is curled upward or downward. On the other hand, the second plate portion 2702 is formed to have a height in the vertical direction lower than that of the first plate portion 2701 so as not to interfere with the trailing edge dropping member 250A even when the trailing edge dropping member 250A is located at the lower position. The upper end edge of the second plate portion 2702 is inclined so as to be lower toward the upstream side in the first conveyance direction.

Further, the first plate portion 2701 is formed so as to extend from the upstream side to the downstream side in the first conveyance direction with respect to the upper discharge roller 230A and the lower discharge roller 230B. Accordingly, even when a sheet is discharged by a first shift discharge process described below, at least the first plate portion 2701 can abut on the sheet. Also, the second plate portion 2702 is located on the processing tray 220 and is formed continuously with the first plate portion 2701 in the first conveyance direction. As a result, at least the second plate portion 2702 can abut on the sheet placed on the processing tray 220 by a second shift discharge process described below.

Stacking Tray

As described above, the sheet discharged by the upper discharge roller 230A and the lower discharge roller 230B is stacked on the stacking tray 300 serving as the stacking portion. The stacking tray 300 is provided downstream of the processing tray 220 in the first conveyance direction so as to be vertically movable downward. The stacking tray 300 is inclined with respect to the horizontal plane such that the upstream side in the first conveyance direction is lower than the downstream side thereof. Such a stacking tray 300 is supported so as to be movable in the vertical direction along rails disposed in the vertical direction, for example, and moves up and down by the driving of a stacking tray elevating motor serving as an elevating unit.

An upstream end of the stacking tray 300 in the first conveyance direction is provided with a rising surface 310*a* serving as a supporting side regulating unit that regulates an upstream end (trailing edge) in a predetermined direction of the sheet or the sheet bundle stacked on the stacking tray 300, and a trailing edge presser 310*b* that presses the trailing edge of the sheet abutting on the rising surface 310*a*. The trailing edge presser 310*b* is inclined toward the downstream side in the first conveyance direction toward the upper side, and can press the trailing edge of the sheet even if the trailing edge of the sheet is curled upward. Further, a sheet pressing paddle 320A is provided coaxially with the rotation shaft of the lower discharge roller 230B.

The stacking tray 300 is movable up and down between a first stacking position and a second stacking position below the first stacking position by a stacking tray elevating motor MT20. The second stacking position is a position at which the operation of the stacking tray 300 that has been lowered when the sheets are discharged to the stacking tray 300 is switched to the rising. At the time of sheet discharge, the sheet pressing paddle 320A rotates as the stacking tray 300 moves up and down, and the sheet or the sheet bundle on the stacking tray 300 is pressed by the sheet pressing paddle 320A.

Control of Each Mode

Next, control of each mode of the present embodiment will be described. In the present embodiment, there are a straight discharge mode in which the sheets sent to the sheet processing apparatus 200A are discharged to the stacking tray 300 as they are without being subjected to predetermined processing, a shift mode in which the sheets sent to the sheet processing apparatus 200A are moved (shifted) in the width direction and discharged to the stacking tray 300, and a staple mode in which the sheets sent to the sheet processing apparatus 200A are stapled as predetermined processing and discharged to the stacking tray 300. Each of these modes is selected by the user.

Further, in the shift mode, there are a case where a shift operation is performed on a sheet (first sheet, small-sized sheet) of which length in the sheet conveyance direction (first conveyance direction) is a first length and a case where a shift operation is performed on a sheet (second sheet, large-sized sheet) of which length in the first conveyance direction is a second length longer than the first length. The small-sized sheet is, for example, a sheet of which length in the first conveyance direction is equal to or less than a predetermined length, and the large-sized sheet is, for example, a sheet of which length in the first conveyance direction is longer than the predetermined length. The predetermined length is, for example, a so-called A4 vertical size in which an A4 size sheet is sent in the vertical direction (direction in which the longitudinal direction is the conveyance direction). Further, in the shift mode, it is possible to select and execute a productivity priority mode in which productivity is prioritized and an alignment priority mode in which alignment of sheets is prioritized.

The productivity priority mode as a first shift discharge process is a mode in which the sheet conveyed to the downstream side in the first conveyance direction by the pre-processing rollers 211A and 212A is shifted in the shift direction by the alignment unit 270A by driving the F-side aligning plate moving motor and the R-side aligning plate moving motor without being conveyed in a second conveyance direction by the reversing paddle 240A, and is discharged to the stacking tray 300 by the upper discharge roller 230A and the lower discharge roller 230B.

The alignment priority mode as a second shift discharge process is a mode in which the sheet conveyed to the downstream side in the first conveyance direction by the pre-processing rollers 211A and 212A is conveyed in the second conveyance direction by the reversing paddle 240A on the processing tray 220, a downstream end edge of the sheet in the second conveyance direction is abutted against (regulated) the trailing edge regulation member 290, then the F-side aligning plate moving motor and the R-side aligning plate moving motor are driven without performing the predetermined process by the staple unit 400, the sheet is shifted in the shift direction by the alignment unit 270A, and the sheet is discharged to the stacking tray 300 by the upper discharge roller 230A and the lower discharge roller 230B.

Manual Binding

A schematic configuration of an appearance of the sheet processing apparatus 200A of the present embodiment configured as described above is as illustrated in FIG. 3. In the sheet processing apparatus 200A of the present embodiment, a manual insertion portion 204 into which a user can manually insert a sheet or a sheet bundle from the outside is provided on the front side of the apparatus in the width direction. The manual insertion portion 204 is a portion into which a corner portion of the sheet bundle is inserted in a case where a user manually binds the sheet bundle by stapling from outside the apparatus. When the user inserts the sheet bundle into the manual insertion portion 204 and presses an operation button 205, the staple unit 400 moves to this position and performs staple processing. Note that a detection unit that detects that the sheet bundle has been inserted may be provided in the manual insertion portion 204, and when the detection unit detects the sheet bundle, the staple unit 400 may be moved to perform the staple process. In this case, the operation button 205 may be omitted.

Sheet Binding Apparatus

Figure 4:
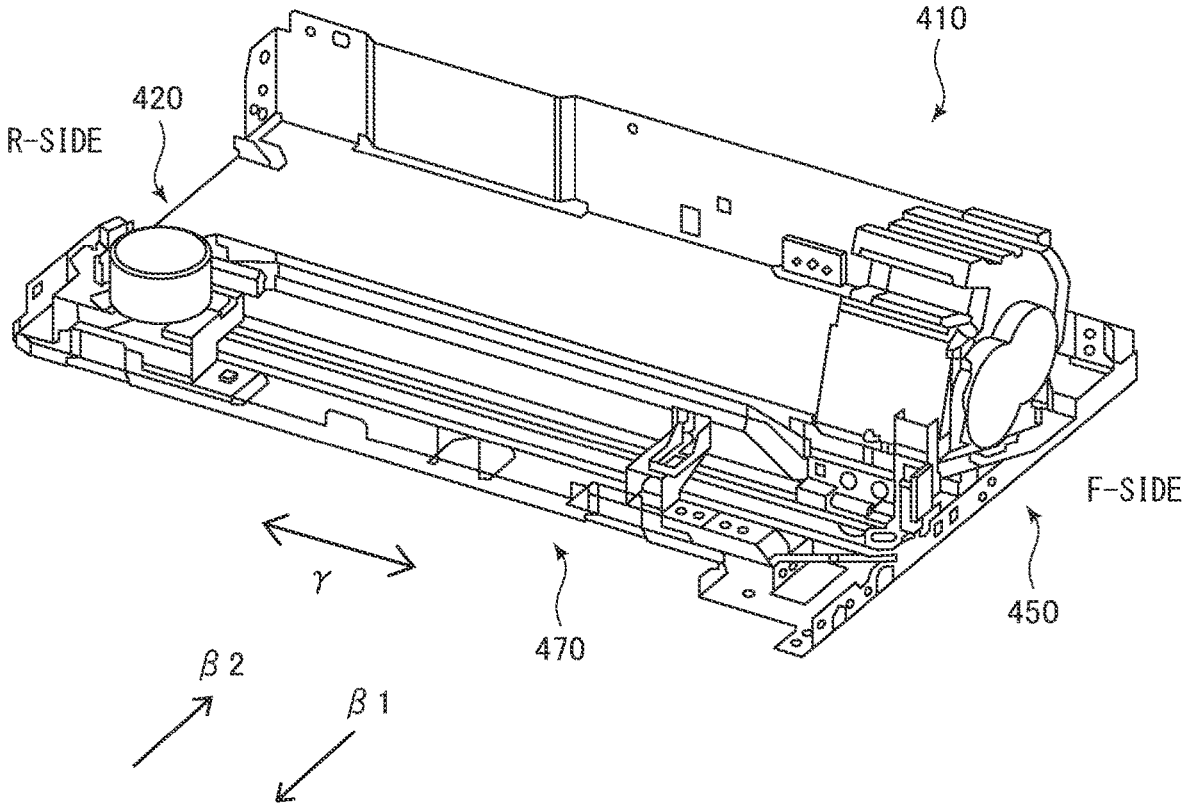
FIG. 4 is a schematic configuration perspective view of the sheet binding apparatus according to the embodiment.
Figure 5:
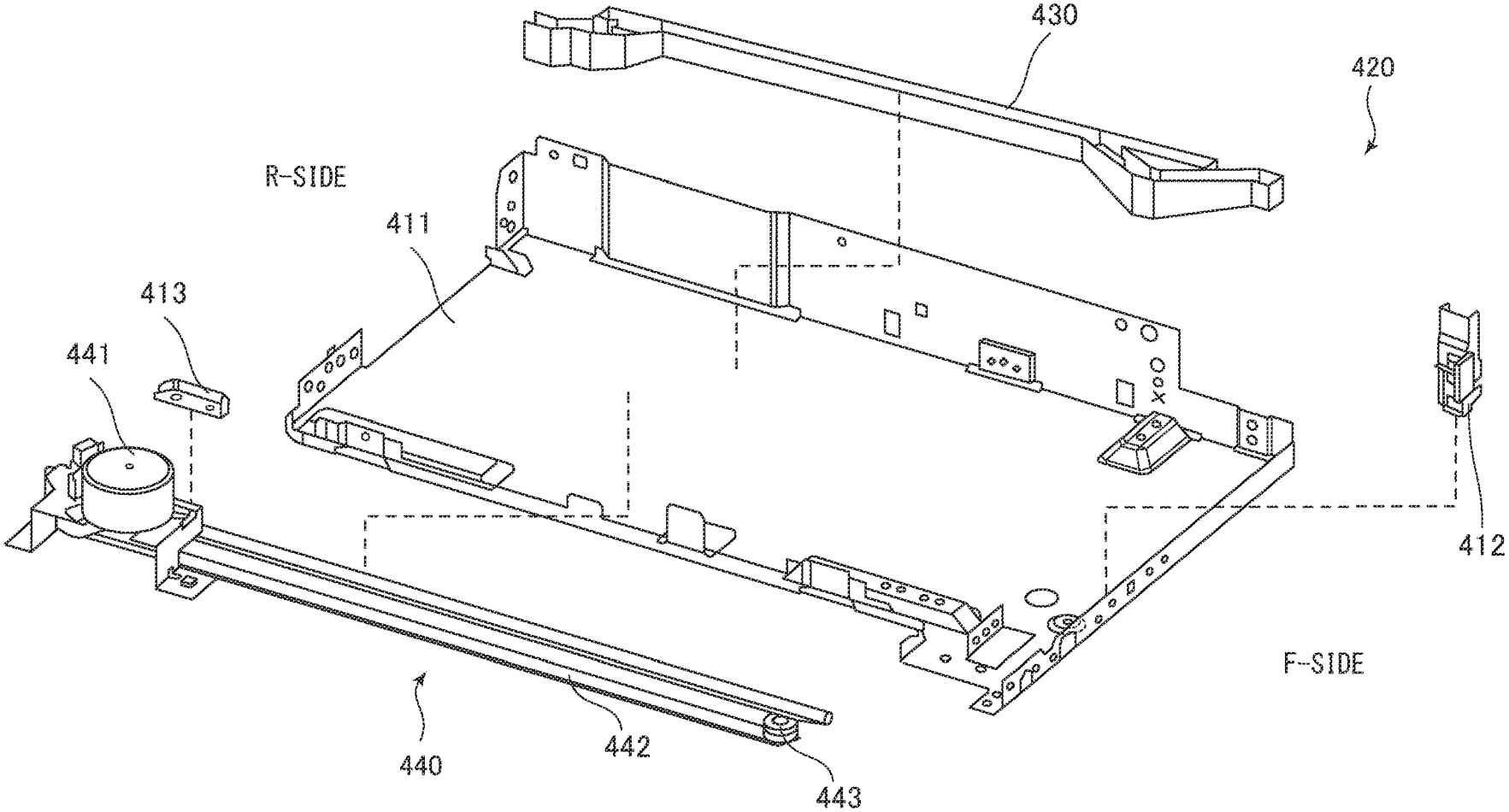
FIG. 5 is an exploded perspective view of a base portion of the sheet binding apparatus according to the embodiment.

Next, the sheet binding apparatus 410 according to the present embodiment will be described with reference to FIGS. 4 to 19. First, an overall configuration of the sheet binding apparatus 410 will be described with reference to FIGS. 4 to 9. In FIGS. 4 and 5, the right front side in the drawings is the front side (F side) of the apparatus, and the left back side is the rear side (R side) of the apparatus. In FIG. 7, the right front side in the drawing is the rear side (R side) of the apparatus, and the left back side is the front side (F side) of the apparatus.

As illustrated in FIG. 4, the sheet binding apparatus 410 includes a base portion 420 and a stapler moving unit 450. As illustrated in FIG. 5, the base portion 420 includes a base 411, a cam groove 430 serving as a guide portion, a drive unit 440, and the like. The cam groove 430 and the drive unit 440 are fixed on the base 411. An HP sensor 412 that detects the home position (HP) of the staple unit 400 and an abutment member 413 are also fixed on the base 411.

Figure 6:
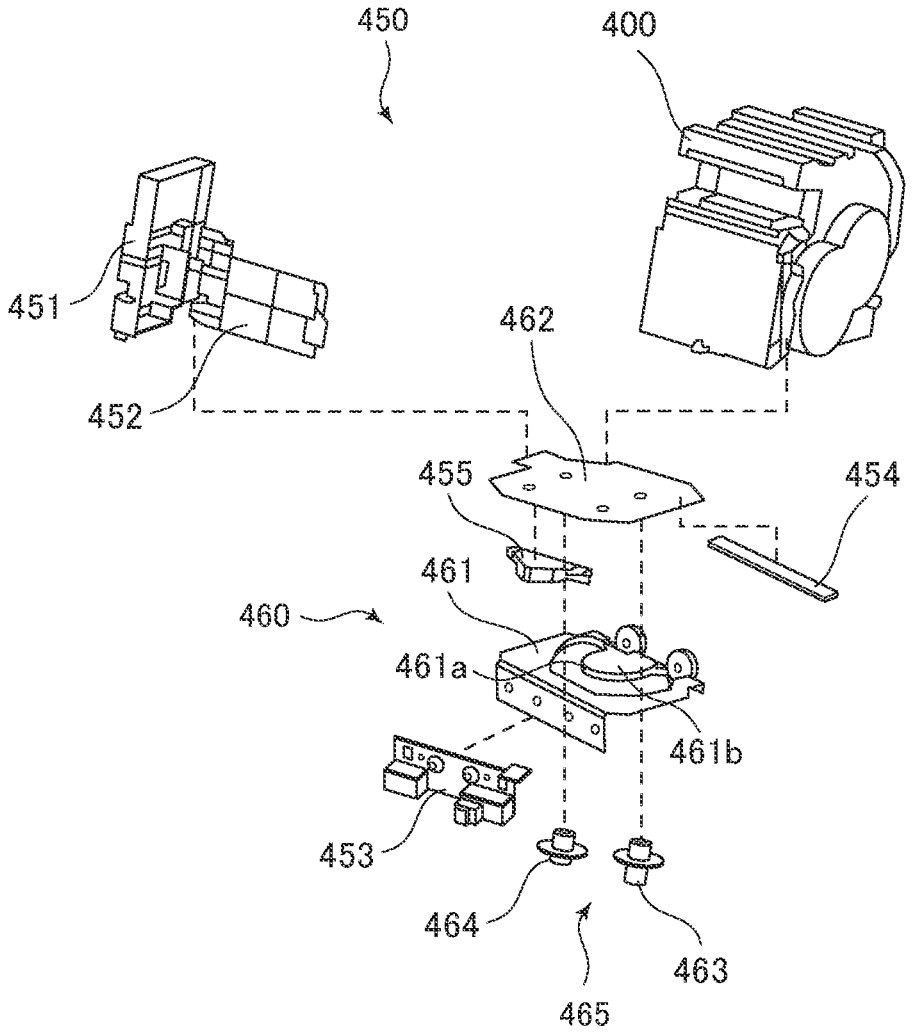
FIG. 6 is an exploded perspective view of a stapler moving unit of the sheet binding apparatus according to the embodiment.
Figure 7:
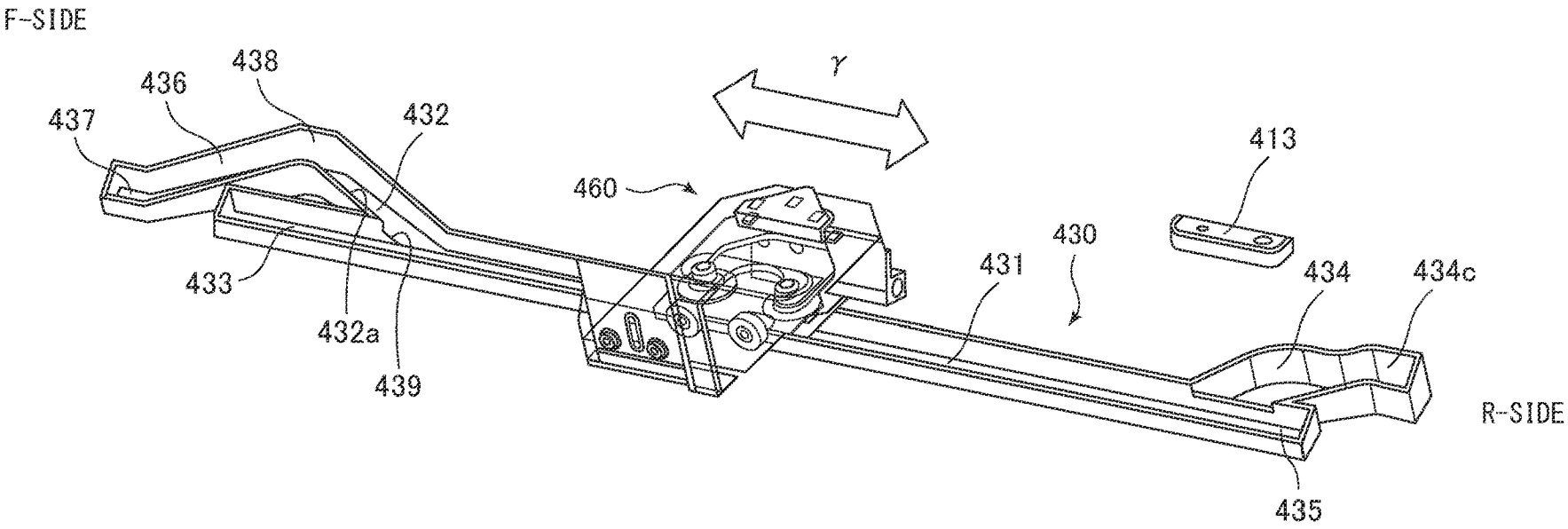
FIG. 7 is a perspective view illustrating a relationship between a cam groove and a stapler holding unit according to the embodiment.

As illustrated in FIG. 6, the stapler moving unit 450 includes a staple unit 400, a stapler holding unit 460, and the like. The stapler holding unit 460 includes a slide plate 461 serving as a moving portion, a rotation plate 462 serving as a rotation holding portion, and an engaging portion 465. The engaging portion 465 includes a first roller 463 serving as a first protrusion and a second roller 464 serving as a second protrusion.

Base Portion

In the base portion 420, the cam groove 430 and the like are fixed on the base 411 as described above. As illustrated in FIG. 7, the cam groove 430 guides movement of the staple unit 400 in a first direction and a second direction opposite to the first direction. Note that FIG. 7 illustrates a relationship between the stapler holding unit 460 and the cam groove 430 by omitting the staple unit 400 in the stapler moving unit 450.

The first direction and the second direction, which are the moving directions of the staple unit 400, are the above-described width direction (an arrow γ direction in FIGS. 3, 4, and 7), and the staple unit 400 is guided by the cam groove 430 to reciprocate between the F side and the R side in the width direction. The above-described HP sensor 412 is disposed in the vicinity of the F-side end of the cam groove 430, and the abutment member 413 is disposed in the vicinity of the R-side end of the cam groove 430, respectively. A detailed configuration of the cam groove 430 will be described below.

As illustrated in FIGS. 4 and 5, the drive unit 440 serving as a driving unit reciprocates the staple unit 400 in the width direction along the cam groove, and includes a motor 441 serving as a drive source and a belt 442. The belt 442 is stretched between a driving pulley (not illustrated) to which driving is transmitted from an output shaft of the motor 441 and a driven pulley 443. In the present embodiment, the motor 441 and the driving pulley are arranged on the R side in the width direction, the driven pulley is arranged on the F side, and the belt 442 is arranged over the width direction. As will be described below, a stapler moving unit 450 is fixed to the belt 442, and when the belt 442 rotates, the stapler moving unit 450 reciprocates in the width direction along the cam groove 430.

Note that the driving unit for moving the staple unit 400 may have a configuration other than the above-described belt configuration. For example, a motor and a pinion gear to which drive is transmitted from an output shaft of the motor are provided on the staple unit 400 side, and a rack gear is provided along the width direction on the base 411 side. Then, the pinion gear and the rack gear are engaged with each other. By driving the motor on the staple unit 400 side, the staple unit 400 moves along the rack gear by the engagement between the pinion gear and the rack gear. As described above, the driving unit may be configured to cause the staple unit 400 to self-propel.

Stapler Moving Unit

As illustrated in FIG. 6, the stapler moving unit 450 includes the staple unit 400, a cable holder 451, a cover 452, a belt holder 453, an inclination regulation member 454, a contact portion 455, the stapler holding unit 460, and the like. The staple unit 400 can perform a binding process on the sheet bundle. The cable holder 451 is a holder that holds a cable connected to an apparatus body of the sheet processing apparatus 200A. The cover 452 covers a connection portion between the staple unit 400 and the cable disposed via the cable holder 451. The staple unit 400 is driven by power supplied from the apparatus body via the cable.

The belt holder 453 is connected to the belt 442 of the drive unit 440 described above. The inclination regulation member 454 regulates an inclination angle of the staple unit 400 as described below. The contact portion 455 is a member that abuts on an abutment member 413 provided in the base portion 420 and serves as a trigger for inclining the staple unit 400 when the staple unit 400 performs oblique binding described below on the R side.

Figure 8A:
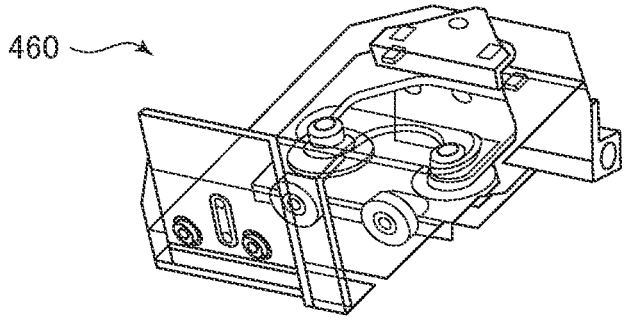
FIG. 8A is a perspective view of the stapler holding unit according to the embodiment.

As illustrated in FIGS. 6 and 8A, the stapler holding unit 460 is obtained by integrally assembling the slide plate 461, the rotation plate 462, the first roller 463, and the second roller 464, and moves along the cam groove 430 integrally with the staple unit 400.

The slide plate 461 moves along the cam groove 430 together with the staple unit 400. For this purpose, the belt holder 453 is fixed to the slide plate 461, and the slide plate 461 moves along the cam groove 430 by the rotation of the belt 442. Further, the slide plate 461 has a guide hole 461*a* as a penetrating portion through which the first roller 463 and the second roller 464 penetrate and which allows the first roller 463 and the second roller 464 to move with the rotation of the staple unit 400.

The rotation plate 462 rotatably holds the staple unit 400 with respect to the slide plate 461, and the staple unit 400 is integrally fixed to the upper surface thereof. The rotation plate 462 is disposed on the upper surface of the slide plate 461 so as to be rotatable with respect to the slide plate 461. Further, the contact portion 455 is fixed to the rotation plate 462, and when the stapler moving unit 450 moves to the R side and the contact portion 455 abuts the abutment member 413, the rotation plate 462 and the staple unit 400 rotate with respect to the slide plate 461. Further, the first roller 463 and the second roller 464 are fixed to the rotation plate 462 at intervals.

The first roller 463 and the second roller 464 are provided to be movable in the width direction together with the staple unit 400 and to be rotatable together with the staple unit 400, and are engaged with the cam groove 430. An outer peripheral surface of at least a portion of the first roller 463 and the second roller 464 engaged with the cam groove 430 is formed in a cylindrical shape. The first roller 463 and the second roller 464 are rotatably fixed to a surface of the rotation plate 462 on a side opposite to a side on which the staple unit 400 is fixed, that is, a lower surface. The first roller 463 and the second roller 464 may not rotate.

In addition, the first roller 463 and the second roller 464 are provided so as to protrude downward from the rotation plate 462, and protrusion amounts of the first roller 463 and the second roller 464 are different from each other. That is, the first roller 463 serving as the first protrusion has a larger protrusion amount from the rotation plate 462 than the second roller 464 serving as the second protrusion. The first roller 463 and the second roller 464 are arranged at a predetermined interval from each other, pass through the guide hole 461*a* formed in the slide plate 461 located below the rotation plate 462, and protrude below the slide plate 461.

The guide hole 461*a* of the slide plate 461 is an opening curved so as to guide the first roller 463 and the second roller 464 in the rotation direction of the staple unit 400, and at least an inner peripheral edge portion of the guide hole 461*a* is formed in a substantially semicircular shape. In the present embodiment, the inner peripheral edge portion of the guide hole 461*a* is a semicircle having a diameter slightly larger than the distance between the outer peripheral surface of the first roller 463 and the outer peripheral surface of the second roller 464. As a result, the first roller 463 and the second roller 464 are movable along the inner peripheral edge portion of the guide hole 461*a*. The guide hole 461*a* has a width larger than the diameters of the first roller 463 and the second roller 464, and is formed to smoothly guide the first roller 463 and the second roller 464. The outer peripheral edge of the guide hole 461*a* may be formed in a substantially semicircular shape, and the first roller 463 and the second roller 464 may be movable along the outer peripheral edge of the guide hole 461*a*.

Further, a straight line connecting both ends of the semicircle of the guide hole 461*a* is substantially parallel to the width direction which is a moving direction of the staple unit 400. Therefore, in a state where the staple unit 400 is not inclined with respect to the width direction, the first roller 463 and the second roller 464 are positioned so as to be arranged substantially parallel to the width direction, and are positioned at the both ends of the semicircle of the guide hole 461*a*. Then, the first roller 463 and the second roller 464 sandwich an arc-shaped plate portion 461*b* on the inner side of the guide hole 461*a* at this position.

When the slide plate 461 is driven by the drive unit 440 to move in the width direction, the first roller 463 and the second roller 464 are engaged with the cam groove 430, and the slide plate 461 moves along the cam groove 430. At this time, the arc-shaped plate portion 461*b* of the slide plate 461 is sandwiched between the first roller 463 and the second roller 464, so that the slide plate 461 and the rotation plate 462 can be integrally and stably moved.

In the above example, the rotation plate 462 is disposed between the staple unit 400 and the slide plate 461, and the first roller 463 and the second roller 464 provided on the rotation plate 462 are disposed so as to penetrate the slide plate 461. However, as long as the staple unit 400 is rotatable with respect to the slide plate 461, the positions of the slide plate 461 and the rotation plate 462 may be interchanged. For example, the staple unit 400 and the rotation plate 462 may be disposed so as to sandwich the slide plate 461, and the staple unit 400 and the rotation plate 462 may be fixed via an arm or the like. In short, the stapler holding unit 460 only needs to be configured to be able to move the staple unit 400 along the cam groove 430 and to be able to rotate the staple unit 400 at a position where oblique binding is performed on the F side and the R side to be described below.

The guide hole 461*a* is not limited to the semicircular curved configuration as described above. For example, on a straight line connecting the center of the first roller 463 and the center of the second roller 464, a round hole having a diameter slightly larger than a distance between positions where the outer peripheral surface of the first roller 463 and the outer peripheral surface of the second roller 464 are farthest from each other may be used. In short, the guide hole 461*a* may be formed so as to guide the first roller 463 and the second roller 464 so that the first roller 463 and the second roller 464 penetrate and may rotate together with the staple unit 400.

Figure 8B:
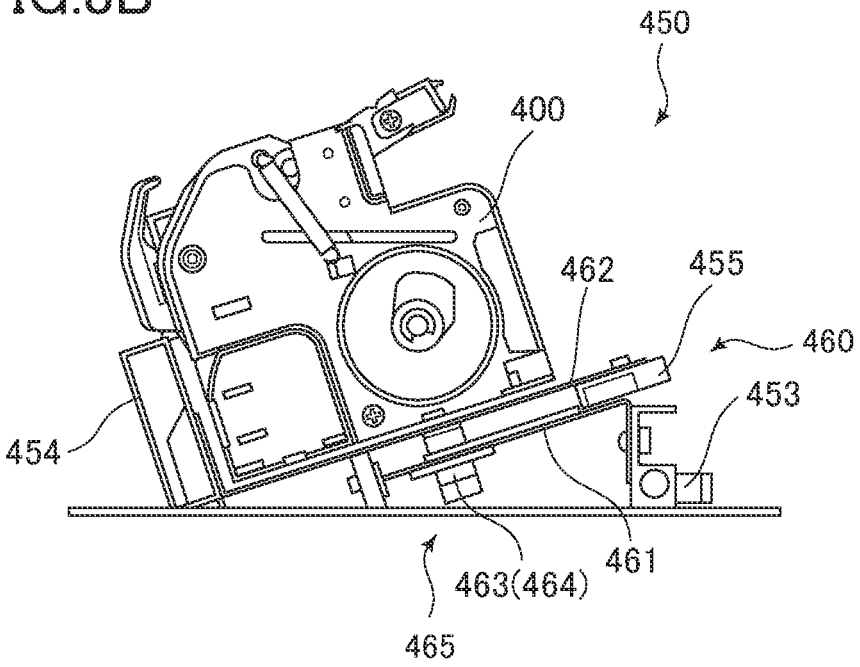
FIG. 8B is a cross-sectional view of the stapler moving unit according to the embodiment.
Figure 9:
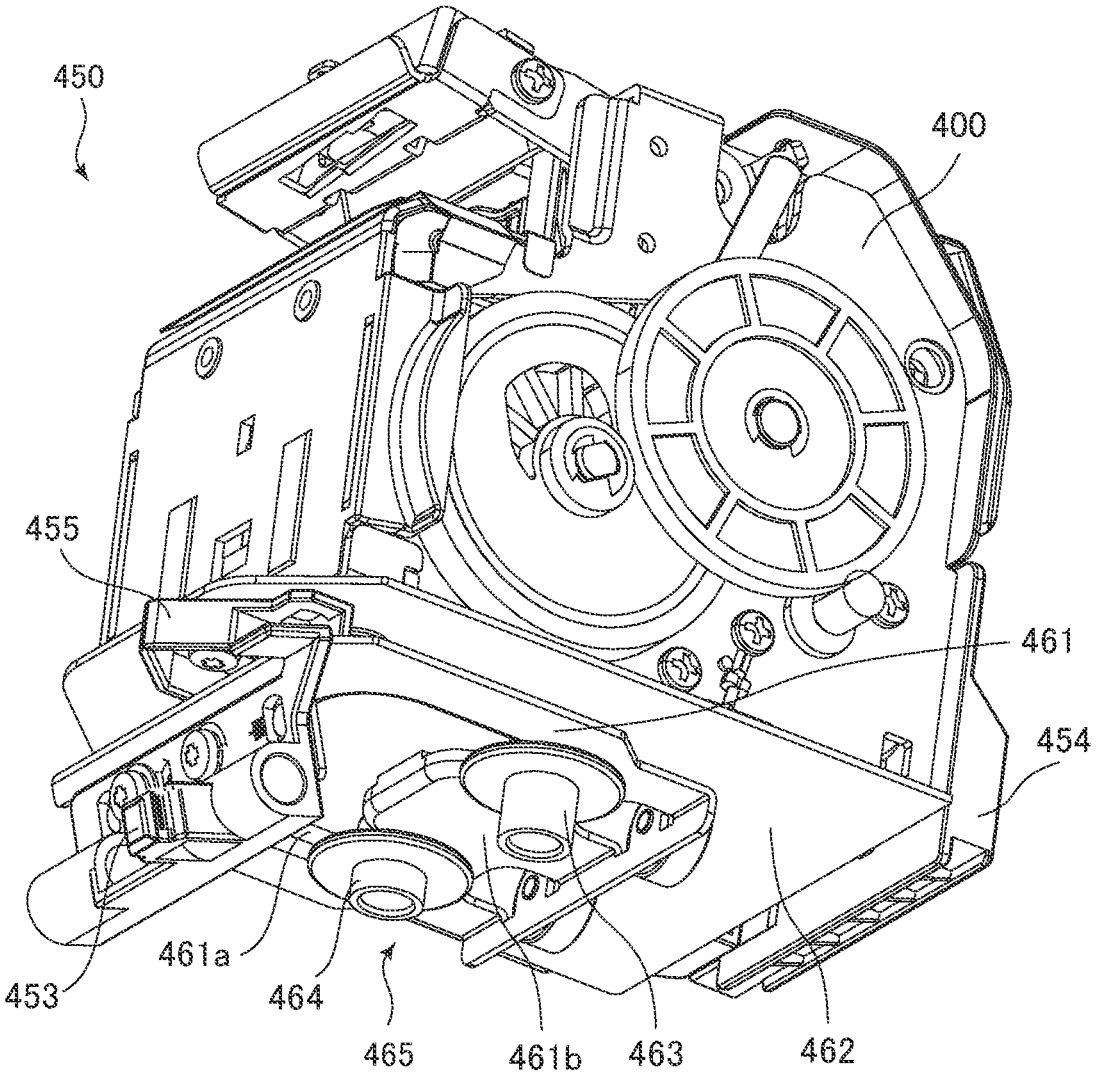
FIG. 9 is a perspective view of the stapler moving unit according to an embodiment.

As illustrated in FIGS. 8B and 9, the stapler moving unit 450 is configured by assembling the staple unit 400 to the stapler holding unit 460. As illustrated in FIG. 8B, the staple unit 400 is disposed to be inclined in accordance with the inclination of the processing tray 220 described above, and the insertion portion 401 into which the sheet bundle, on which the binding process is performed, is inserted is directed obliquely upward. The inclination regulation member 454 described above is disposed on the back surface of the staple unit 400 on the side opposite to the insertion portion 401, and the inclination of the staple unit 400 is regulated by the inclination regulation member 454 abutting on the base 411. As a result, it is possible to prevent the staple unit 400 from being excessively inclined when the staple unit 400 moves in the width direction. The position of the inclination regulation member 454 in the vertical direction can be adjusted.

Cam Groove

Figure 10:
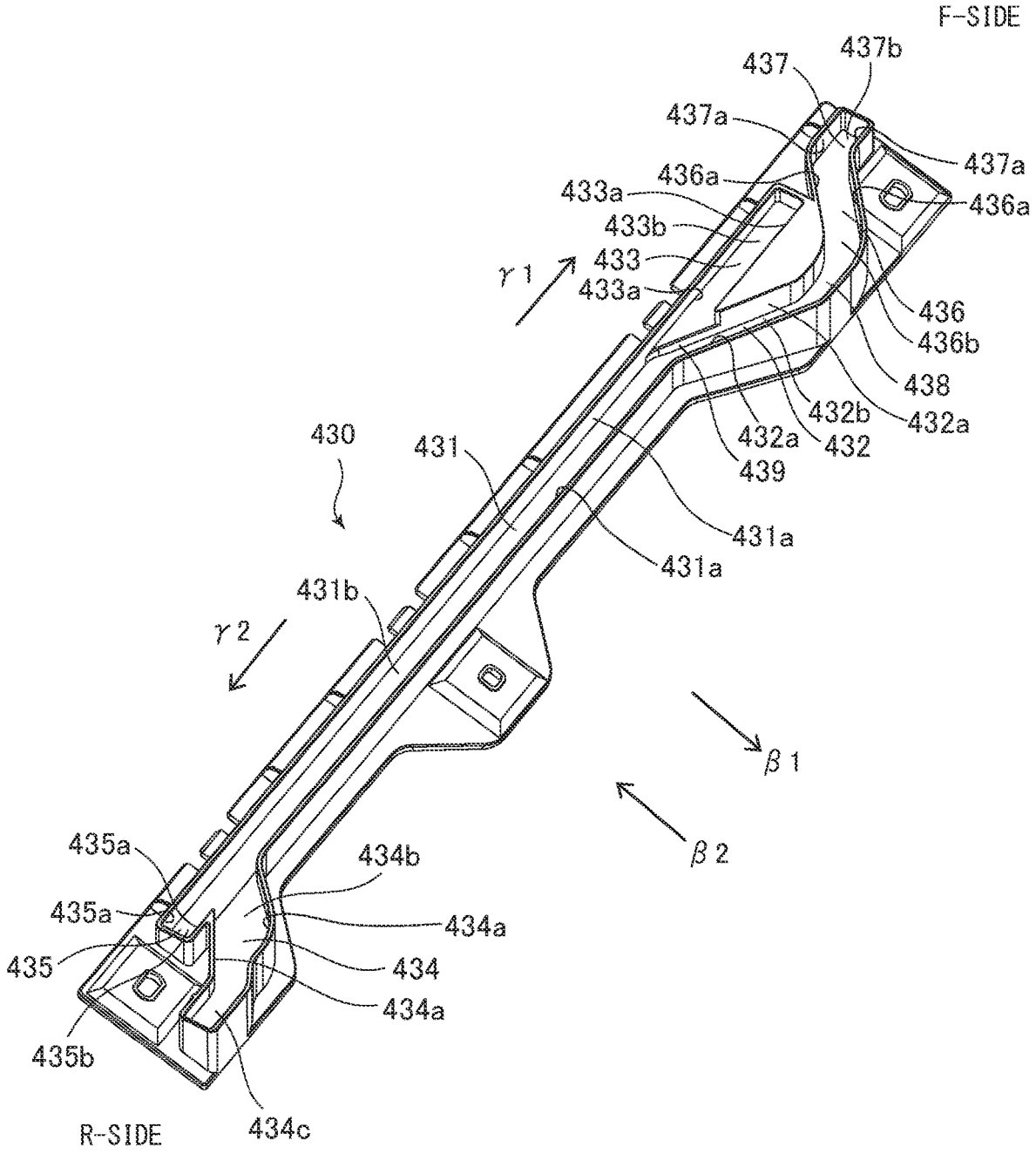
FIG. 10 is a perspective view of the cam groove according to the embodiment.
Figure 11:
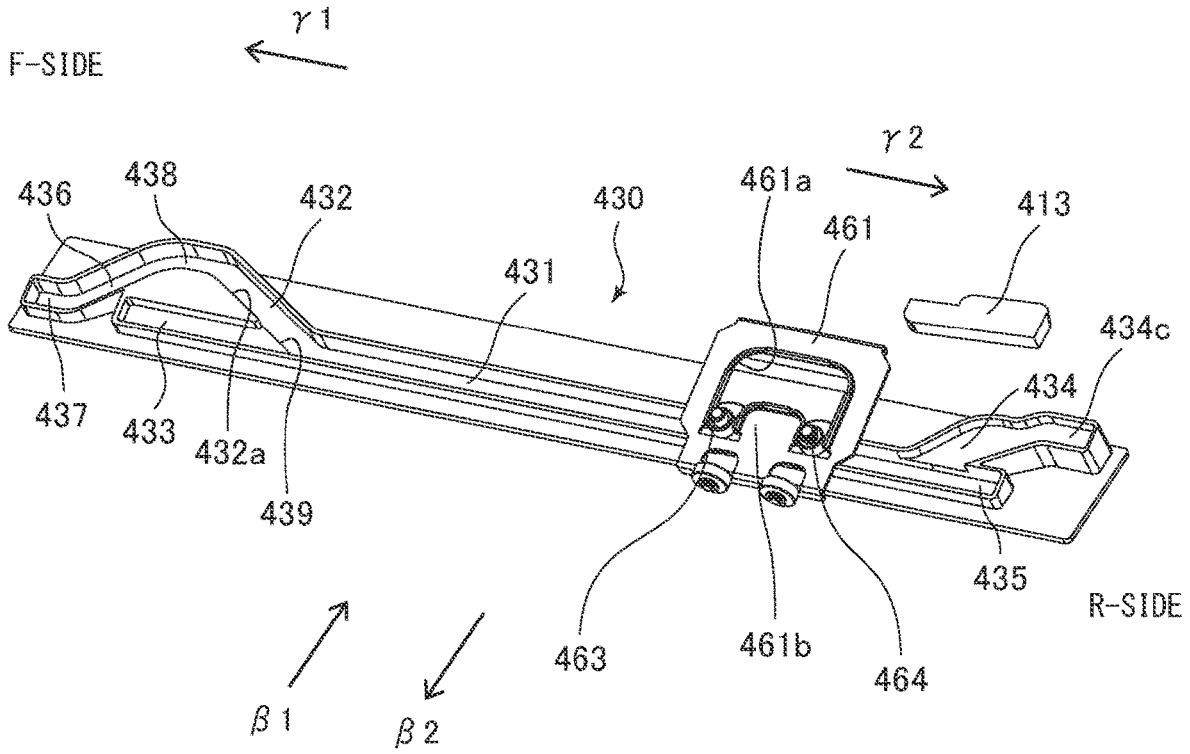
FIG. 11 is a perspective view illustrating a relationship between the cam groove and a moving portion according to the embodiment.
Figure 12:
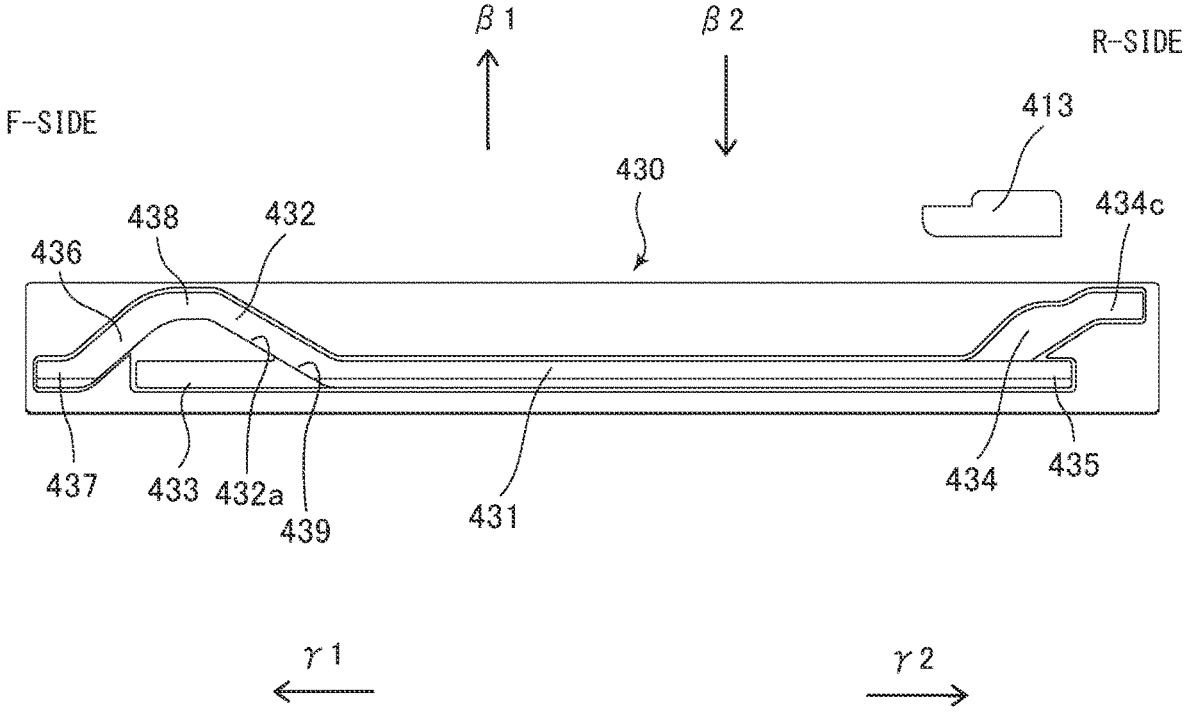
FIG. 12 is a plan view of the cam groove according to the embodiment.

Next, the cam groove 430 will be described with reference to FIGS. 10 to 12. Here, the first direction and the second direction are directions along the above-described width direction, and the first direction is indicated by an arrow γ1 and the second direction is indicated by an arrow γ2. In the present embodiment, the first direction is a direction toward the F side along the width direction, and the second direction is a direction toward the R side along the width direction. The relationship between the first direction and the second direction may be reversed depending on the configuration of the device. In addition, a direction of an arrow β1 illustrated in FIGS. 10 to 12 is the above-described first conveyance direction, and a direction of an arrow β2 is the above-described second conveyance direction. The first conveyance direction β1 is a direction in which the sheet is conveyed toward the processing tray 220 by the above-described pre-processing rollers 211A and 212A, and the second conveyance direction β2 is a direction in which the sheet on the processing tray 220 is conveyed toward the trailing edge regulation member 290 by the above-described reversing paddle 240A.

The cam groove 430 includes a first groove 431, a second groove 432, a third groove 433, a fourth groove 434, a fifth groove 435, a sixth groove 436, and a seventh groove 437. In the present embodiment, the second groove 432, the third groove 433, the sixth groove 436, and the seventh groove 437 are disposed on the downstream side in the first direction γ1 of the first groove 431, that is, on the F side. On the other hand, the fourth groove 434 and the fifth groove 435 are disposed on the downstream side in the second direction γ2 of the first groove 431, that is, on the R side. Each groove has a width slightly larger than the diameters of the first roller 463 and the second roller 464, and is formed such that the first roller 463 and the second roller 464 may engage and are guided without rattling. In the present embodiment, the outer diameters of the first roller 463 and the second roller 464 are the same, and the widths of the grooves are also the same. Hereinafter, each groove will be described in detail.

The first groove 431 has a pair of wall portions (first wall portions) 431*a* and a bottom portion 431*b* and is formed along the first direction γ1. The pair of wall portions 431*a* is arranged to face each other so that the first roller 463 and the second roller 464 can enter therebetween. In other words, the pair of wall portions 431*a* is disposed so as to guide the first roller 463 and the second roller 464 so as to be movable along the first direction γ1 in a state where the first roller 463 and the second roller 464 are located therebetween. The bottom portion 431*b* is a bottom portion of the groove between the pair of wall portions 431*a*. The first groove 431 is opened on the side opposite to the bottom portion 431*b*, and the first roller 463 and the second roller 464 are engaged with the pair of wall portions 431*a* through the opening. Note that the bottom portion 431*b* can be omitted. That is, the first groove 431 may be a through hole having a pair of wall portions 431*a*.

The second groove 432 has a pair of wall portions (second wall portions) 432*a* and a bottom portion 432*b*, and is formed along a direction inclined with respect to the first direction γ1 from a downstream end of the first groove 431 in the first direction γ1. That is, the second groove 432 is inclined with respect to the width direction, and an inclination direction is a direction toward the downstream side in the first conveyance direction β1 as it goes toward the downstream side in the first direction γ1. The pair of wall portions 432*a* is arranged to face each other so that the first roller 463 can enter therebetween. In other words, the pair of wall portions 432*a* is disposed so as to guide the first roller 463 movably along the inclination direction (a direction toward the downstream side in the first conveyance direction β1 as it goes toward the downstream side in the first direction γ1) from the downstream end in the first direction γ1 of the first groove 431 in a state where the first roller 463 is disposed between the wall portions. The bottom portion 432*b* is a bottom portion of the groove between the pair of wall portions 432*a*. The second groove 432 is opened on the side opposite to the bottom portion 432*b*, and the first roller 463 is engaged with the pair of wall portions 432*a* through the opening. Note that the bottom portion 432*b* can be omitted. That is, the second groove 432 may be a through hole having the pair of wall portions 432*a*.

The third groove 433 has a pair of wall portions (third wall portions) 433*a* and a bottom portion 433*b*, and is formed along the first direction γ1 from the downstream end of the first groove 431 in the first direction γ1. That is, the third groove 433 is formed in a similar manner as the first groove 431, on the downstream side of the first groove 431 in the first direction γ1, extending downstream side from the first groove 431. The pair of wall portions 433*a* is arranged to face each other so that the second roller 464 can enter therebetween. In other words, the pair of wall portions 433*a* is disposed so as to guide the second roller 464 so as to be movable along the first direction γ1 from the downstream end of the first groove 431 in the first direction γ1 in a state where the second roller 464 is disposed between the wall portions. The bottom portion 433*b* is a bottom portion of the groove between the pair of wall portions 433*a*. The third groove 433 is opened on the side opposite to the bottom portion 433*b*, and the second roller 464 is engaged with the pair of wall portions 433*a* through the opening. Note that the bottom portion 433*b* can be omitted. That is, the third groove 433 may be a through hole having a pair of wall portions 433*a*.

The fourth groove 434 has a pair of wall portions (fourth wall portions) 434*a* and a bottom portion 434*b*, and is formed along a direction inclined with respect to the second direction γ2 from a downstream end of the first groove 431 in the second direction γ2. That is, the fourth groove 434 is inclined with respect to the width direction, and an inclination direction is a direction toward the downstream side in the first conveyance direction β1 as it goes toward the downstream side in the second direction γ2. The pair of wall portions 434*a* is arranged to face each other so that the second roller 464 can enter therebetween. In other words, the pair of wall portions 434*a* is disposed so as to guide the second roller 464 so as to be movable along the inclination direction (a direction toward the downstream side in the first conveyance direction β1 as it goes toward the downstream side in the second direction γ2) from the downstream end of the first groove 431 in the second direction γ2 in a state where the second roller 464 is disposed between the wall portions. The bottom portion 434*b* is a bottom portion of the groove between the pair of wall portions 434*a*. The fourth groove 434 is opened on the side opposite to the bottom portion 434*b*, and the second roller 464 is engaged with the pair of wall portions 434*a* through the opening. Note that the bottom portion 434*b* can be omitted. That is, the fourth groove 434 may be a through hole having a pair of wall portions 434*a*.

The fifth groove 435 has a pair of wall portions (fifth wall portions) 435*a* and a bottom portion 435*b*, and is formed along the second direction γ2 from the downstream end of the first groove 431 in the second direction γ2. That is, the fifth groove 435 is formed in a similar manner as the first groove 431, on the downstream side of the first groove 431 in the second direction γ2, extending downstream side from the first groove 431. The pair of wall portions 435*a* is arranged to face each other so that the first roller 463 can enter therebetween. In other words, the pair of wall portions 435*a* is disposed so as to guide the first roller 463 movably along the second direction γ2 from the downstream end in the second direction γ2 of the first groove 431 in a state where the first roller 463 is disposed between the wall portions. The bottom portion 435*b* is a bottom portion of the groove between the pair of wall portions 435*a*. The fifth groove 435 is opened on the side opposite to the bottom portion 435*b*, and the first roller 463 is engaged with the pair of wall portions 435*a* through the opening. Note that the bottom portion 435*b* can be omitted. That is, the fifth groove 435 may be a through hole having a pair of wall portions 435*a*.

The sixth groove 436 has a pair of wall portions (sixth wall portions) 436*a* and a bottom portion 436*b*, and is formed on the downstream side of the second groove 432 in the first direction γ1 along a direction inclined in a direction opposite to the second groove 432 with respect to the first direction γ1. That is, the sixth groove 436 is inclined with respect to the width direction, and the inclination direction is a direction toward the upstream side in the first conveyance direction β1, that is, the downstream side in the second conveyance direction β2 as it goes toward the downstream side in the first direction γ1. Between the second groove 432 and the sixth groove 436, a switching groove 438 for switching a rotation direction of the first roller 463 with respect to the second roller 464 is provided as described below. The pair of wall portions 436*a* is arranged to face each other so that the first roller 463 can enter therebetween. In other words, the pair of wall portions 436*a* is disposed so as to guide the first roller 463 so as to be movable along the inclination direction (a direction inclined in the direction opposite to the second groove 432 with respect to the first direction γ1) from the downstream end in the first direction γ1 of the second groove 432 in a state where the first roller 463 is disposed between the wall portions. The bottom portion 436*b* is a bottom portion of the groove between the pair of wall portions 436*a*. The sixth groove 436 is opened on the side opposite to the bottom portion 436*b*, and the first roller 463 is engaged with the pair of wall portions 436*a* through the opening. Note that the bottom portion 436*b* can be omitted. That is, the sixth groove 436 may be a through hole having a pair of wall portions 436*a*.

The seventh groove 437 has a pair of wall portions (seventh wall portions) 437*a* and a bottom portion 437*b*, and is formed along the first direction γ1 from the downstream end in the first direction γ1 of the sixth groove 436. The seventh groove 437 is located at the same position as the first groove 431 and the third groove 433 in the first conveyance direction β1, and when the first roller 463 enters the seventh groove 437 as described below, the direction of the stapler moving unit 450 is the same as the case where the first roller 463 and the second roller 464 are located in the first groove 431. The pair of wall portions 437*a* is arranged to face each other so that the first roller 463 can enter therebetween. In other words, the pair of wall portions 437*a* is disposed so as to guide the first roller 463 movably along the first direction γ1 from the downstream end in the first direction γ1 of the sixth groove 436 in a state where the first roller 463 is disposed between the wall portions. The bottom portion 437*b* is a bottom portion of the groove between the pair of wall portions 437*a*. The seventh groove 437 is opened on the side opposite to the bottom portion 437*b*, and the first roller 463 is engaged with the pair of wall portions 437*a* through the opening. Note that the bottom portion 437*b* can be omitted. That is, the seventh groove 437 may be a through hole having a pair of wall portions 437*a*.

Relationship Between Each Groove and First Roller and Second Roller

Next, a relationship between the grooves and the first roller 463 and the second roller 464 will be described with reference to FIGS. 10 to 15B. In the following description, the "depth of the groove" in each groove is the same as the "height of the wall portion" in each groove. In the present embodiment, among the grooves described above, the third groove 433 is formed such that the depth of the groove is shallower (the height of the wall portion is lower) than the other grooves. As described above, the first roller 463 and the second roller 464 have different protrusion amounts from the rotation plate 462. As a result, engagement amounts of the first roller 463 and the second roller 464 with respect to the groove are made different. Here, the "engagement amount" is an amount by which the first roller 463 and the second roller 464 enter the pair of wall portions in the height direction of the wall portion (the length direction of the first roller 463 and the second roller 464), in other words, a length of a portion in which the first roller 463 and the second roller 464 abut on the pair of wall portions in the height direction of the wall portion. The second roller 464 is disposed upstream side of the first roller 463 in the first direction γ1, that is, on the R side.

Note that the first roller 463 and the second roller 464 have different lengths so as to have different protrusion amounts from the rotation plate 462, but may have the same length as long as the engagement amount with the groove is different. For example, by changing the attachment position in the height direction (a depth direction of the groove) with respect to the rotation plate 462, the engagement amount of the first roller 463 and the second roller 464 with respect to the groove can be changed even if the lengths are the same.

Here, the stapler moving unit 450 moves in the first direction γ1 and the second direction γ2, and each of the first roller 463 and the second roller 464 are positioned in any one of the grooves described above, whereby the posture of the staple unit 400 can be changed. Specifically, the staple unit 400 can be changed to a first posture and a second posture inclined with respect to the first posture. In the present embodiment, the drive unit 440 that moves the staple unit 400, the stapler holding unit 460 that holds the staple unit 400, and the cam groove 430 constitute a movable turning unit 470 (FIG. 4) that moves the staple unit 400 in the width direction and further turns the staple unit 400 between the first posture and the second posture inclined with respect to the first posture.

The first posture is a posture in which the staple unit 400 performs the binding process in the direction along the width direction with respect to a downstream edge portion of the sheet in the second conveyance direction β2, that is, a side stitch binding posture. The second posture is a posture in which the staple unit 400 performs the binding process in a direction inclined with respect to the width direction with respect to the corner portion on a first end side or a second end side (the F side or the R side in the present embodiment) in the width direction of the downstream edge portion of the sheet in the second conveyance direction β2, that is, a posture in which the staple unit performs the oblique binding. Note that the inclination direction with respect to the width direction is opposite between the second posture on the F side and the second posture on the R side.

The sheet binding apparatus 410 according to the present embodiment can execute a first binding process in which the staple unit 400 performs side stitching to a downstream edge portion (trailing edge portion) of the sheet in the second conveyance direction β2 in the first posture, a second binding process in which the staple unit 400 performs oblique binding to the first end side (F side) of the downstream edge portion (trailing edge portion) of the sheet in the second conveyance direction β2 in the second posture, and a third binding process in which the staple unit 400 performs oblique binding to the second end side (R side) of the downstream edge portion (trailing edge portion) of the sheet in the second conveyance direction β2 in the second posture.

Figure 13A:
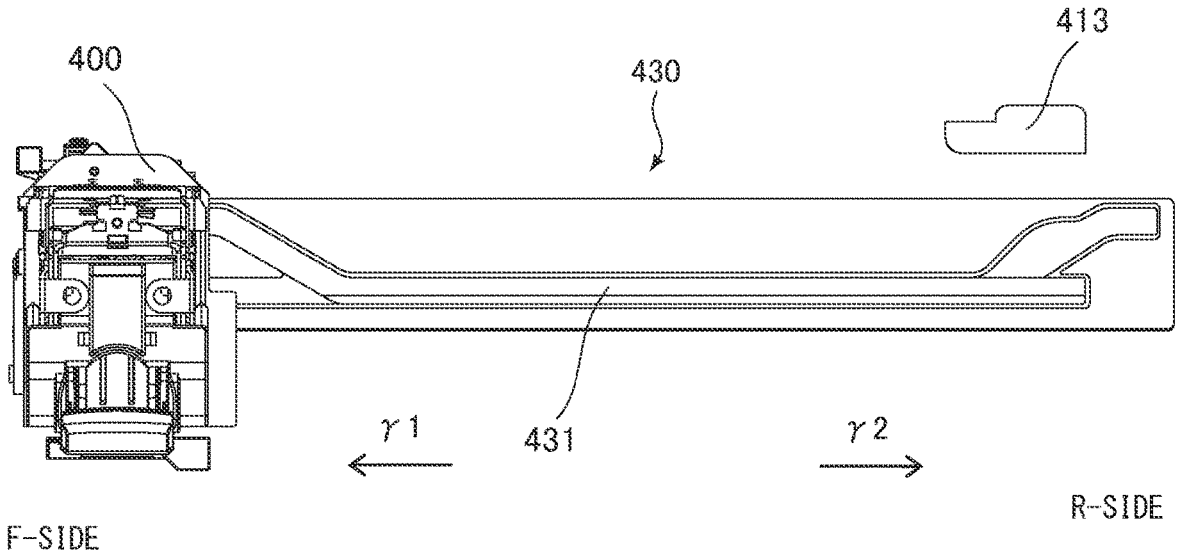
FIG. 13A is a plan view illustrating a relationship between the cam groove and the stapler moving unit at a home position.
Figure 13B:
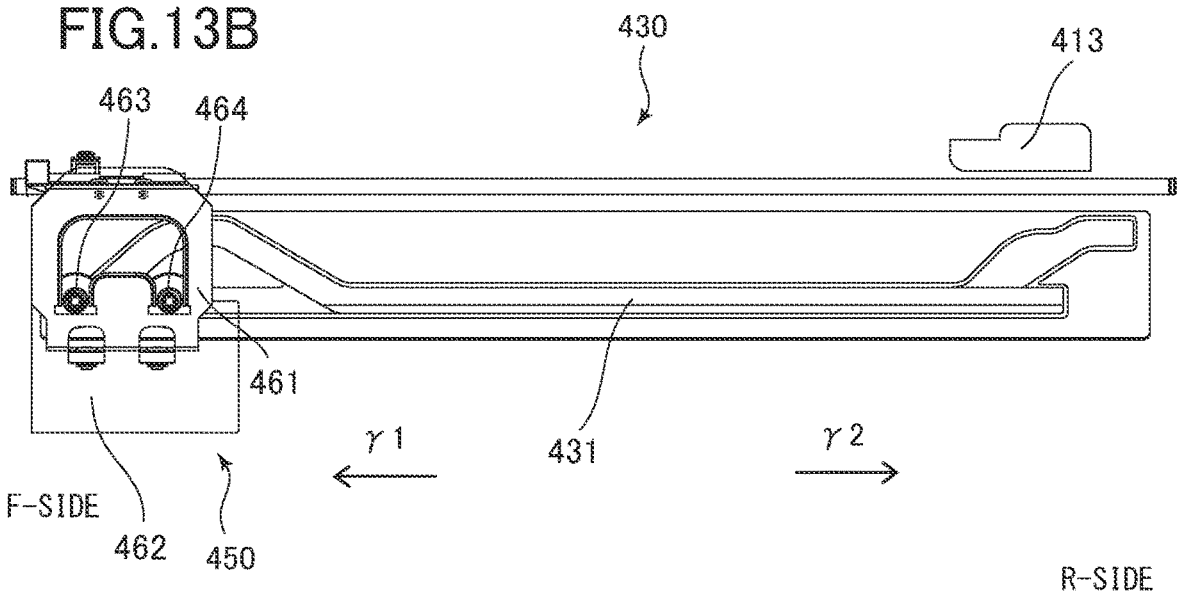
FIG. 13B is a plan view illustrating a relationship between the cam groove and the moving portion at the home position.
Figure 14A:
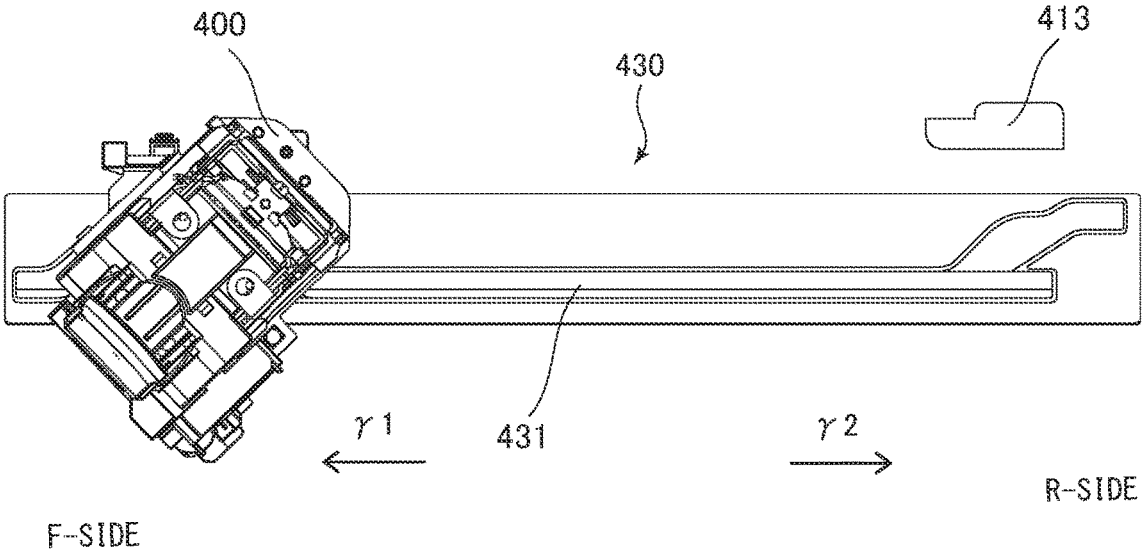
FIG. 14A is a plan view illustrating a relationship between the cam groove and the stapler moving unit at an oblique binding position on a front side.
Figure 14B:
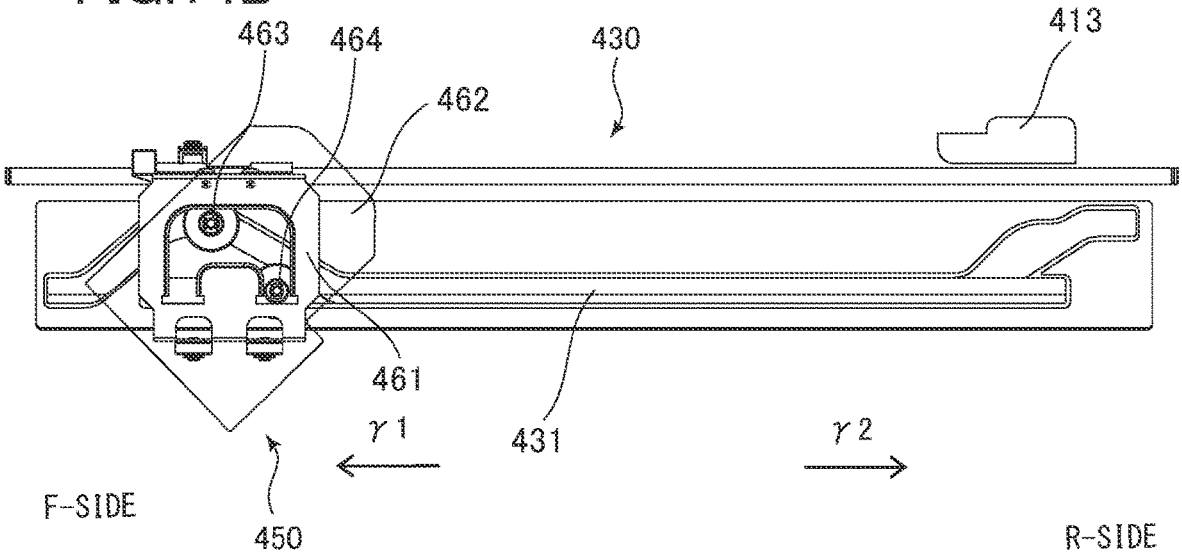
FIG. 14B is a plan view illustrating a relationship between the cam groove and the moving portion at the oblique binding position on the front side.
Figure 15A:
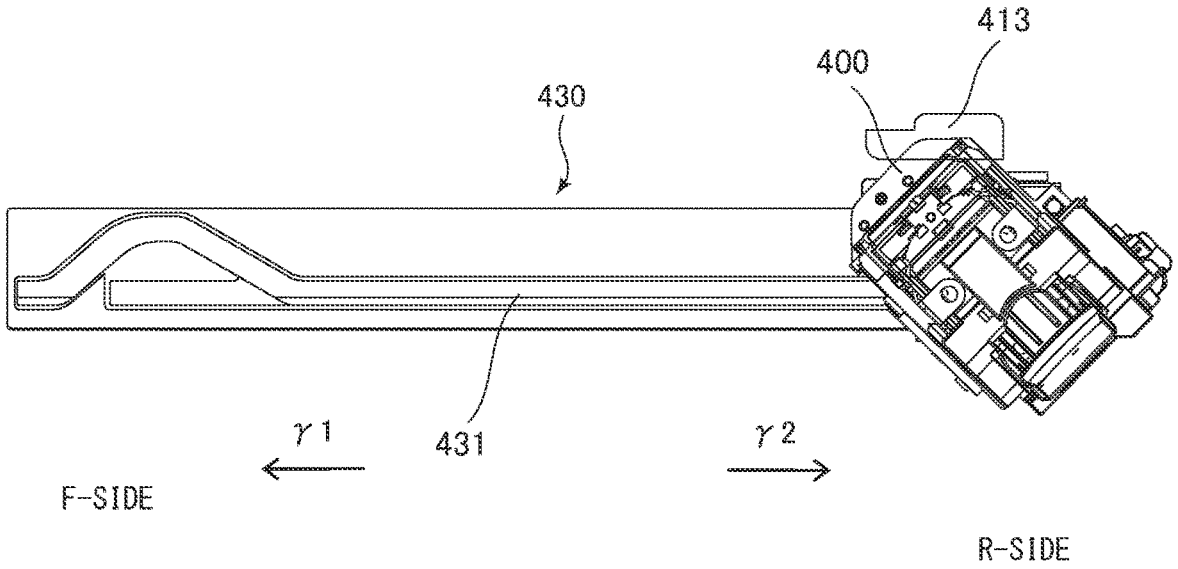
FIG. 15A is a plan view illustrating a relationship between the cam groove and the stapler moving unit at an oblique binding position on a rear side.
Figure 15B:
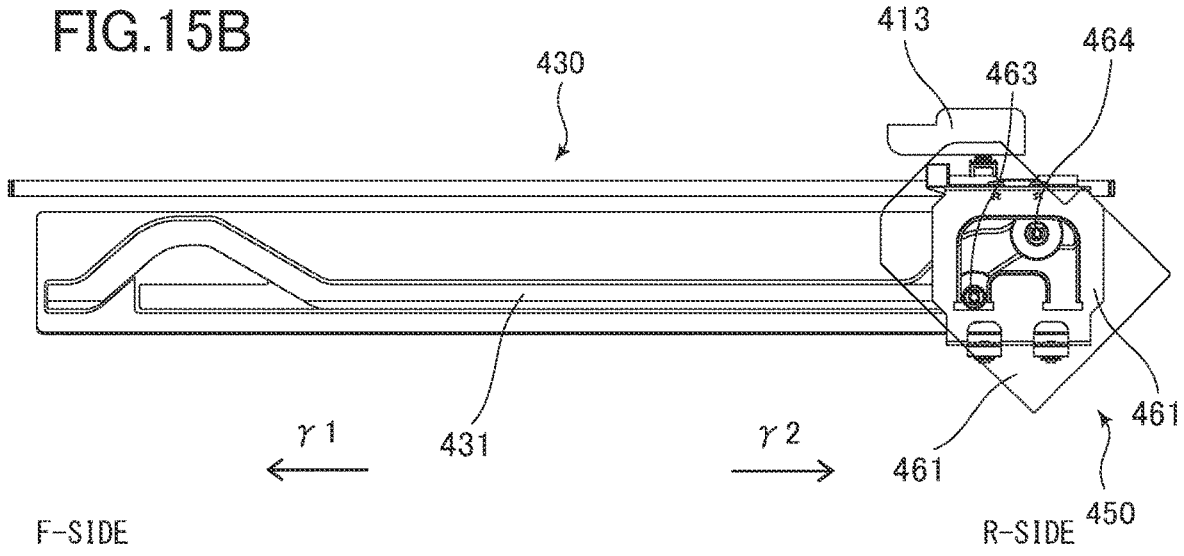
FIG. 15B is a plan view illustrating a relationship between the cam groove and the moving portion at the oblique binding position on the rear side.

FIGS. 13A and 13B illustrate a state in which the stapler moving unit 450 is at the home position (HP). At the home position, the staple unit 400 takes the same posture as the first posture, but does not perform the binding process on the sheets. FIGS. 14A and 14B illustrate the second posture on the F side, and FIGS. 15A and 15B illustrate the second posture on the R side, respectively.

First Groove and F-Side Groove

First, a relationship between the first groove 431, the second groove 432, the third groove 433, the sixth groove 436, and the seventh groove 437 on the downstream side in the first direction γ1 of the first groove 431, that is, on the F side, and the first roller 463 and the second roller 464 will be described. The first roller 463 can be engaged with the first groove 431 and the second groove 432 by a first engagement amount. On the other hand, the second roller 464 can be engaged with the first groove 431 and the third groove 433 by a second engagement amount smaller than the first engagement amount.

The third groove 433 has a stepped surface 439 serving as a restricting portion that restricts entry of the first roller 463 from the first groove 431 and permits entry of the second roller 464 from the first groove 431. That is, the first groove 431 and the second groove 432 are formed such that the depth of the groove is deeper than the first engagement amount. That is, the heights of the first wall portion 431*a* and the second wall portion 432*a* are higher than the first engagement amount. On the other hand, the third groove 433 is formed such that the depth of the groove is shallower than the first engagement amount and deeper than the second engagement amount. That is, the height of the third wall portion 433*a* is lower than the first engagement amount and higher than the second engagement amount. The stepped surface 439 between the third groove 433 and the first groove 431 restricts the first roller 463 from entering the third groove 433 (between the pair of third wall portions 433*a*) from the first groove 431 (between the pair of first wall portions 431*a*), and allows the second roller 464 to enter the third groove 433 from the first groove 431.

Therefore, when the stapler moving unit 450 moves to the downstream side in the first direction γ1 toward the third groove 433 along the first groove 431, the first roller 463 on the downstream side in the first direction γ1 with respect to the second roller 464 abuts on the stepped surface 439. The stepped surface 439 is formed in parallel with the inclination direction of the second groove 432, and is on the same plane as the inner wall surface of the wall portion 433*a* on the upstream side in the first conveyance direction β1, that is, on the third groove 433 side, of the pair of wall portions 432*a* of the second groove 432. Therefore, when the stapler moving unit 450 further attempts to move downstream side in the first direction γ1 in a state of being in contact with the stepped surface 439, the first roller 463 is guided to the second groove 432 along the inclination of the stepped surface 439.

On the other hand, with the movement of the stapler moving unit 450 to the downstream side in the first direction γ1, the second roller 464 located upstream side of the first roller 463 in the first direction γ1 reaches the position of the stepped surface 439 after the first roller 463 is guided to the second groove 432. The engagement amount of the second roller 464 with the groove is smaller than the amount of engagement of the first roller 463 with the groove, and the third groove 433 is formed deeper than the engagement of the second roller 464 with the groove. Therefore, when the stapler moving unit 450 moves downstream side in the first direction γ1, the second roller 464 is engaged with the third groove 433 without being in contact with the stepped surface 439.

With such an operation, the first roller 463 is engaged with the second groove 432, the second roller 464 is engaged with the third groove 433, and the rotation plate 462 to which the first roller 463 and the second roller 464 are fixed rotates with respect to the slide plate 461. At this time, the first roller 463 rotates about the second roller 464 along the guide hole 461*a* formed in the slide plate 461, so that the engagement of the first roller 463 with the second groove 432 and rotation of the rotation plate 462 become possible.

Then, when the stapler moving unit 450 further moves to the downstream side in the first direction γ1, the first roller 463 reaches the switching groove 438 as illustrated in FIG. 14B. The switching groove 438 has a pair of wall portions and a bottom portion similarly to each groove described above. The same applies to the point that the bottom portion may be omitted. Such a switching groove 438 can be engaged with the first roller 463, and has the same depth as the second groove 432 in the present embodiment. Switching groove 438 is formed substantially parallel to the first groove 431. Therefore, when the first roller 463 is positioned in the switching groove 438, the position of the first roller 463 with respect to the second roller 464 is stabilized in the first conveyance direction β1.

That is, in a state where the first roller 463 enters the second groove 432, the positional relationship with the second roller 464 changes depending on the position of the first roller 463 on the second groove 432, and the angle of the staple unit 400 held by the rotation plate 462 also changes. On the other hand, when the first roller 463 is engaged with the switching groove 438, the angle of the staple unit 400 is stabilized regardless of the position of the first roller 463 on the switching groove 438. Then, at this position, the staple unit 400 takes the second posture as illustrated in FIG. 14A for performing oblique binding on the F side as described above. As described above, in the present embodiment, the switching groove 438 functions as a positioning groove of the first roller 463 for causing the staple unit 400 to take the second posture on the F side. Note that the staple unit 400 may take the second posture in a state where the first roller 463 is positioned in the second groove 432.

The restricting portion that restricts the entry of the first roller 463 from the first groove 431 and permits the entry of the second roller 464 from the first groove 431 is not limited to the stepped surface 439 described above. For example, the restricting portion may be a horizontal bar provided at an upstream end of the third groove 433 in the first direction γ1 at a position shallower than the first engagement amount and deeper than the second engagement amount. In this case, the third groove may have the same depth as the first groove.

Next, a relationship between the sixth groove 436 and the seventh groove 437 formed continuously with the switching groove 438 on the downstream side in the first direction γ1 of the switching groove 438 and the first roller 463 and the second roller 464 will be described. The sixth groove 436 and the seventh groove 437 have a depth with which the first roller 463 can be engaged, and in the present embodiment, have the same depth as the second groove 432.

As described above, when the first roller 463 is engaged with the second groove 432 and the stapler moving unit 450 moves to the downstream side in the first direction γ1, the first roller 463 passes through the switching groove 438 and is engaged with the sixth groove 436. At this time, the first roller 463 rotates about the second roller 464 along the guide hole 461*a* formed in the slide plate 461. The rotation direction at this time is opposite to the rotation direction when the first roller 463 is engaged with the second groove 432 from the first groove 431. As a result, the rotation direction of the first roller 463 with respect to the second roller 464 is switched by the switching groove 438, and the engagement with the sixth groove 436 and the rotation of the rotation plate 462 become possible.

Next, when the stapler moving unit 450 further moves to the downstream side in the first direction γ1, the first roller 463 is engaged with the seventh groove 437 as illustrated in FIG. 13B. As described above, the seventh groove 437 is formed along the first direction γ1, and is located at the same position as the first groove 431 and the third groove 433 with respect to the first conveyance direction β1. Therefore, when the first roller 463 is engaged with the seventh groove 437, the first roller 463 rotates about the second roller 464 along the guide hole 461*a* formed in the slide plate 461, and the rotation plate 462 and the staple unit 400 held by the rotation plate take a posture as illustrated in FIG. 13A. This posture is the same posture as when the first roller 463 and the second roller 464 are in the first groove 431. In the present embodiment, the case where the first roller 463 is positioned in the seventh groove 437 is set as the home position (HP) of the stapler moving unit 450.

In the present embodiment, the above-described manual binding operation can be performed at the home position, that is, the position where the first roller 463 is engaged with the seventh groove 437. That is, when the stapler moving unit 450 is located at the home position, a portion of the staple unit 400 that performs the binding process is located in the manual insertion portion 204 (FIG. 3). Therefore, when the user inserts the sheet bundle into the manual insertion portion 204 in this state, the sheet bundle is engaged with the portion where the binding process is performed, and the binding process can be performed.

R-Side Groove

Next, a relationship between the fourth groove 434 and the fifth groove 435 on the downstream side in the second direction γ2 of the first groove 431, that is, on the R side, and the first roller 463 and the second roller 464 will be described. The second roller 464 can be engaged with the fourth groove 434, and the first roller 463 can be engaged with the fifth groove 435. In the present embodiment, the fourth groove 434 has the same depth as the third groove 433, and the fifth groove 435 has the same depth as the first groove 431. The fourth groove 434 may have the same depth as the fifth groove 435.

As described above, the abutment member 413 is disposed in the vicinity of the R-side end of the cam groove 430. As illustrated in FIGS. 11 and 12, the abutment member 413 serving as the abutted portion is disposed outside the first groove 431 to the seventh groove 437 (outside the pair of first wall portions 431*a* to the pair of seventh wall portions 437*a*). In the present embodiment, the abutment member 413 is disposed at the downstream end portion of the first groove 431 in the second direction γ2 and is disposed on the downstream side of the fourth groove 434 in the first conveyance direction β1. On the other hand, the rotation plate 462 is provided with the contact portion 455.

When the stapler moving unit 450 moves to the downstream side in the second direction γ2 along the first groove 431 and approaches the vicinity of the downstream end portion in the second direction γ2 of the first groove 431, the contact portion 455 abuts against the abutment member 413. When the stapler moving unit 450 further moves to the downstream side in the second direction γ2, the contact portion 455 and the abutment member 413 abut on each other, so that the rotation plate 462 rotates. At this time, the second roller 464 rotates about the first roller 463 along the guide hole 461*a* formed in the slide plate 461. As a result, the second roller 464 is engaged with the fourth groove 434 formed along the direction inclined with respect to the second direction γ2 from the downstream end of the first groove 431 in the second direction γ2. As a result, the staple unit 400 held by the rotation plate 462 rotates in the direction opposite to the rotation direction when the first roller 463 is engaged with the second groove 432.

That is, when the second roller 464 is at a position where the second roller 464 can be engaged with the fourth groove 434 (between the pair of fourth wall portions 434*a*) from the first groove 431 (between the pair of first wall portions 431*a*), the contact portion 455 provided on the rotation plate 462 abuts on the abutment member 413. Then, as the staple unit 400 moves from this position in the second direction, the staple unit 400 turns, and the second roller 464 is engaged with the fourth groove 434.

On the downstream side in the second direction γ2 of the fourth groove 434, a positioning groove 434*c* is provided so as to be continuous with the fourth groove 434. The positioning groove 434*c* has a pair of wall portions and a bottom portion similarly to each groove described above. The same applies to the point that the bottom portion may be omitted. Such a positioning groove 434*c* has the same depth as the fourth groove 434 and is formed in parallel with the first groove 431. On the downstream side of the first groove 431 in the second direction γ2, the fifth groove 435 is formed along the second direction γ2 from the downstream end in the second direction γ2 of the first groove 431.

As described above, when the second roller 464 is engaged with the fourth groove 434 and the stapler moving unit 450 further moves to the downstream side in the second direction γ2, the first roller 463 located at the upstream side in the second direction γ2 with respect to the second roller 464 moves in the first groove 431 as it is. Then, as illustrated in FIG. 15B, the second roller 464 is engaged with the positioning groove 434*c*, and the first roller 463 is engaged with the fifth groove 435. Then, at this position, the staple unit 400 takes the second posture as illustrated in FIG. 15A for performing oblique binding on the R side as described above.

Similarly to the above-described switching groove 438, the positioning groove 434*c* stabilizes the posture of the staple unit 400. However, the staple unit 400 may take the second posture in a state where the second roller 464 is positioned in the fourth groove 434, and in this case, the positioning groove 434*c* may be omitted. Further, the fifth groove 435 is formed by extending the first groove 431 in order to move the second roller 464 to the positioning groove 434*c*, the fifth groove 435 may be omitted as long as the staple unit 400 can be brought into the second posture without moving the first roller 463 to the fifth groove 435.

Moving Position and Posture of Staple Unit

Figure 17A:
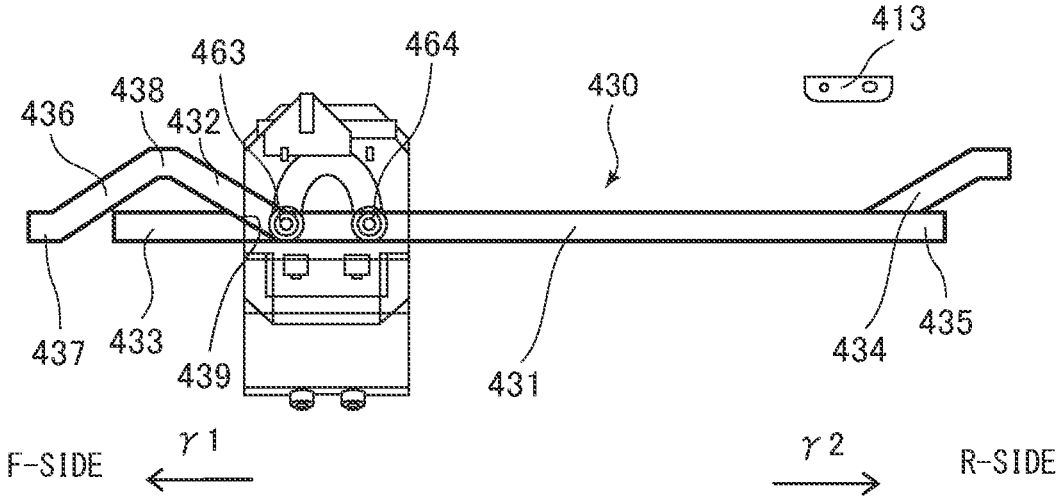
FIG. 17A is a schematic diagram illustrating a relationship between the cam groove and the stapler moving unit, the relationship illustrating a first state of movement of the stapler moving unit from the first groove to the oblique binding position on the front side.
Figure 17B:
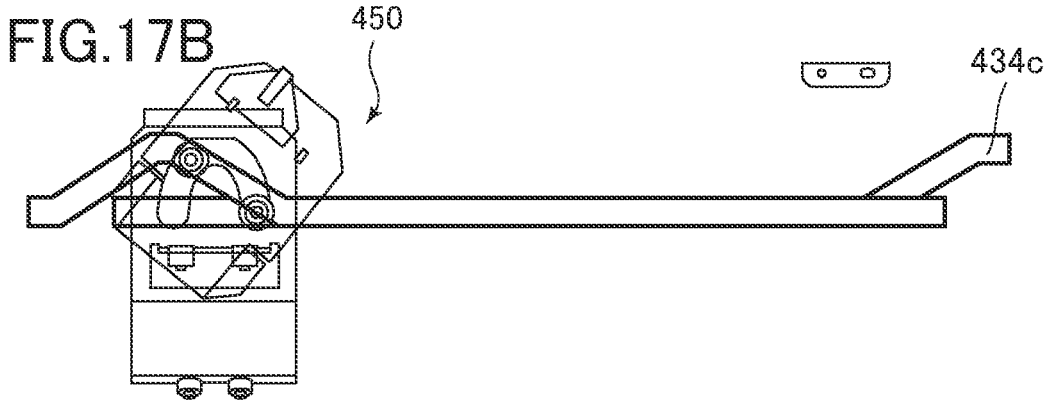
FIG. 17B is a schematic diagram illustrating a relationship between the cam groove and the stapler moving unit, the relationship illustrating a second state of movement of the stapler moving unit from the first groove to the oblique binding position on the front side.
Figure 17C:
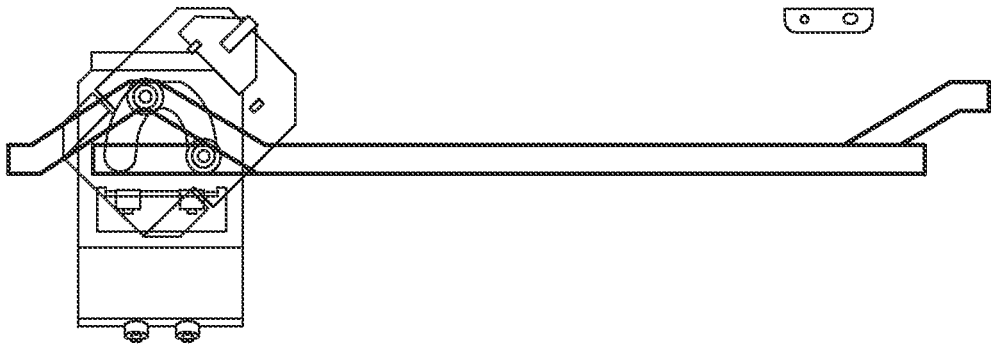
FIG. 17C is a schematic view illustrating a relationship between the cam groove and the stapler moving unit, the relationship illustrating a third state of movement of the stapler moving unit from the first groove to the oblique binding position on the front side.
Figure 18A:
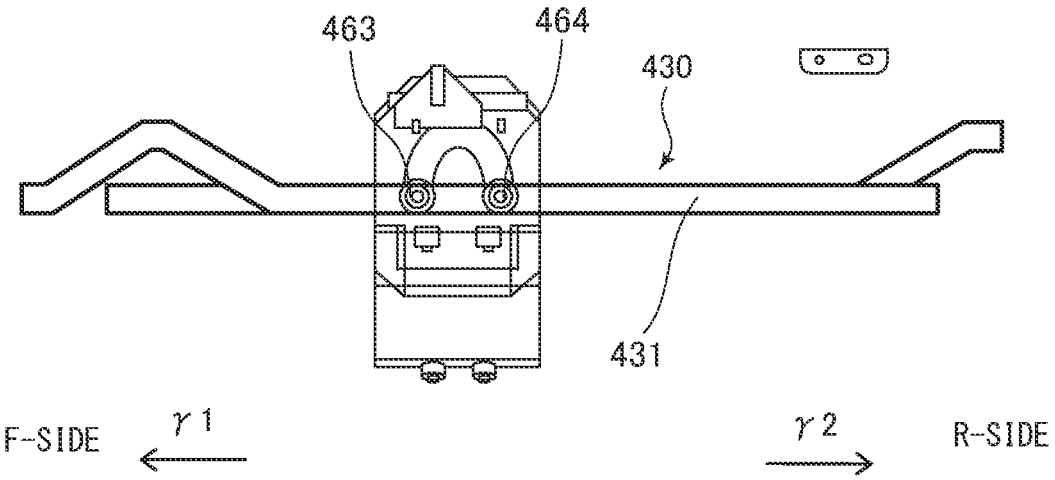
FIG. 18A is a schematic diagram illustrating a relationship between the cam groove and the stapler moving unit, the relationship illustrating a state in which the stapler moving unit is located at a side stitch binding position on the front side.
Figure 18B:
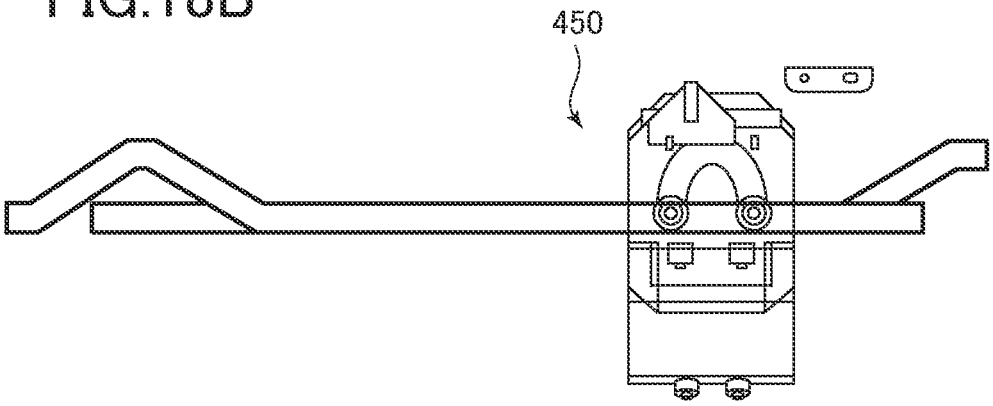
FIG. 18B is a schematic view illustrating a relationship between the cam groove and the stapler moving unit, the relationship illustrating a state in which the stapler moving unit is located at a side stitch binding position on the rear side.
Figure 19A:
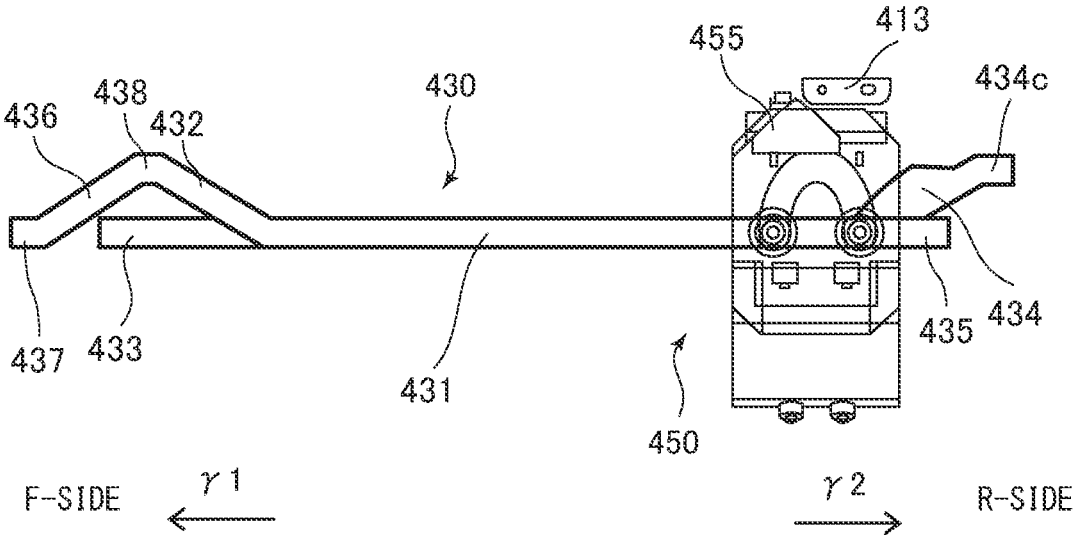
FIG. 19A is a schematic diagram illustrating a relationship between the cam groove and the stapler moving unit, the relationship illustrating a first state of movement of the stapler moving unit from the first groove to the oblique binding position on the rear side.
Figure 19B:
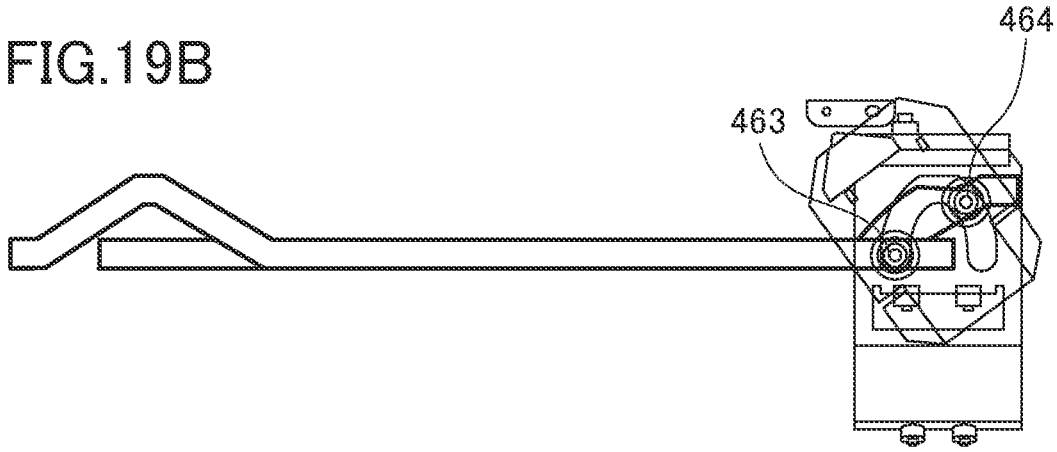
FIG. 19B is a schematic diagram illustrating a relationship between the cam groove and the stapler moving unit, the relationship illustrating a second state of movement of the stapler moving unit from the first groove to the oblique binding position on the rear side.
Figure 19C:
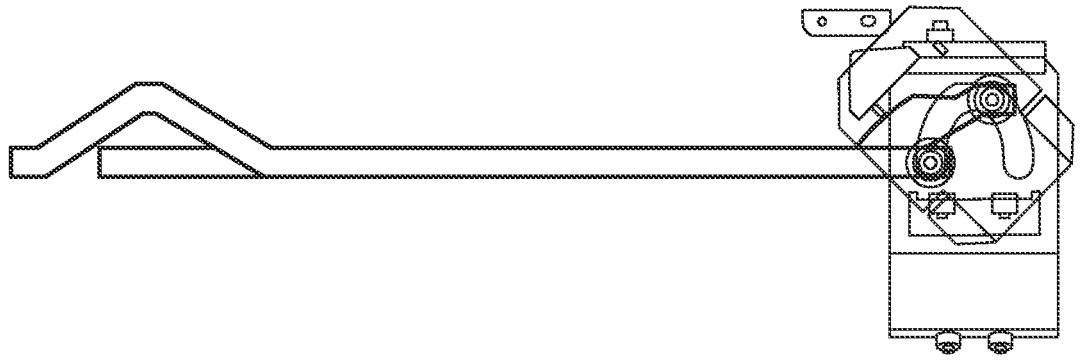
FIG. 19C is a schematic view illustrating a relationship between the cam groove and the stapler moving unit, the relationship illustrating a third state of movement of the stapler moving unit from the first groove to the oblique binding position on the rear side.

Next, the position of the staple unit 400 in the cam groove 430 and the posture at that time will be described with reference to FIGS. 16A to 19C. FIGS. 16A to 16E sequentially illustrate a state in which the stapler moving unit 450 moves from the home position to the first groove 431. FIGS. 17A to 17C sequentially illustrate a state in which the stapler moving unit 450 moves from the first groove 431 to the oblique binding position on the F side. FIGS. 18A and 18B illustrate a state in which the stapler moving unit 450 is located at different side stitch binding positions on the first groove 431. FIGS. 19A to 19C sequentially illustrate a state in which the stapler moving unit 450 moves from the first groove 431 to the oblique binding position on the R side.

Movement from Home Position to First Groove 431

Figures 16A, 16B, 16C, 16D, 16E:
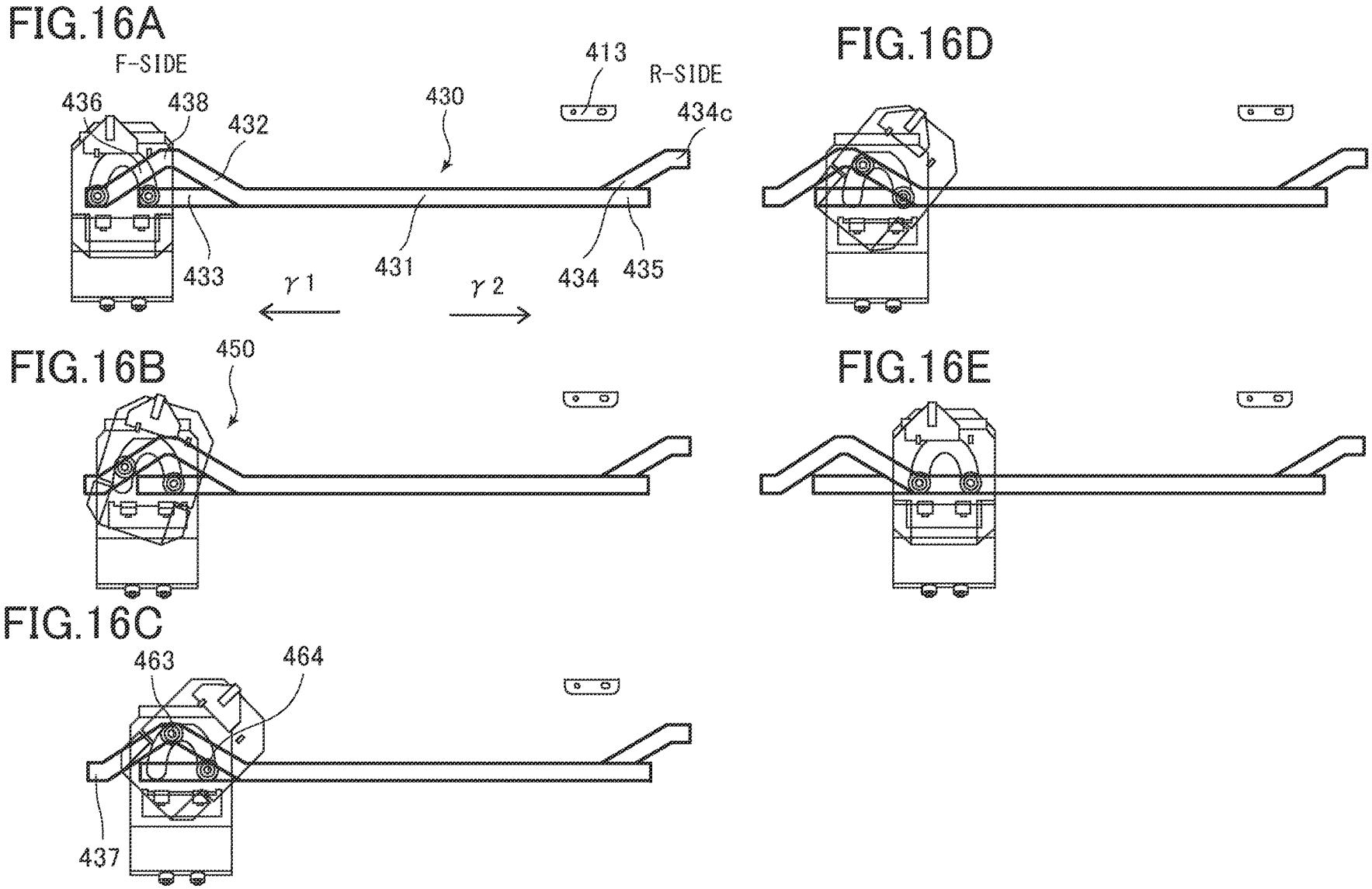
FIG. 16A is a schematic diagram illustrating a relationship between the cam groove and the stapler moving unit, the relationship illustrating a first state of movement of the stapler moving unit from the home position to a first groove.
FIG. 16B is a schematic diagram illustrating a relationship between the cam groove and the stapler moving unit, the relationship illustrating a second state of movement of the stapler moving unit from the home position to the first groove.
FIG. 16C is a schematic diagram illustrating a relationship between the cam groove and the stapler moving unit, the relationship illustrating a third state of movement of the stapler moving unit from the home position to the first groove.
FIG. 16D is a schematic diagram illustrating a relationship between the cam groove and the stapler moving unit, the relationship illustrating a fourth state of movement of the stapler moving unit from the home position to the first groove.
FIG. 16E is a schematic diagram illustrating a relationship between the cam groove and the stapler moving unit, the relationship illustrating a fifth state of movement of the stapler moving unit from the home position to the first groove.

FIG. 16A illustrates a state in which the stapler moving unit 450 is in a home position. In this state, as described above, the first roller 463 is located in the seventh groove 437, and the second roller 464 is located in the third groove 433. When the stapler moving unit 450 moves from this position to the downstream side in the second direction γ2, as illustrated in FIG. 16B, the first roller 463 is engaged with the sixth groove 436, and the second roller 464 moves along the third groove 433. At this time, the first roller 463 rotates in the clockwise direction in the drawing around the second roller 464, whereby the staple unit 400 is inclined.

When the stapler moving unit 450 further moves to the downstream side in the second direction γ2, the first roller 463 is engaged with the switching groove 438 and enters the state of FIG. 16C. The posture of the staple unit 400 in this state is the above-described second posture. Next, when the stapler moving unit 450 further moves to the downstream side in the second direction γ2, the first roller 463 is engaged with the second groove 432 as illustrated in FIG. 16D. Further, when the stapler moving unit 450 further moves to the downstream side in the second direction γ2, the first roller 463 is engaged with the first groove 431 as illustrated in FIG. 16E. In this state, the first roller 463 and the second roller 464 are positioned in the first groove 431, and the staple unit 400 takes the first posture. An operation of moving from this position to the home position is reversed to that described above.

Movement from First Groove to F Side Oblique Binding Position

FIG. 17A illustrates a state in which the first roller 463 and the second roller 464 are located in the first groove 431 and the first roller 463 is located near the downstream end portion of the first groove 431 in the first direction γ1. When the stapler moving unit 450 moves from this position to the downstream side in the first direction γ1, the first roller 463 is guided by the stepped surface 439, as illustrated in FIG. 17B, the first roller 463 is engaged with the second groove 432, and the second roller 464 starts to be engaged with the third groove 433. At this time, the first roller 463 rotates in the clockwise direction in the drawing around the second roller 464, whereby the staple unit 400 is inclined.

Next, when the stapler moving unit 450 further moves to the downstream side in the first direction γ1, the first roller 463 is engaged with the switching groove 438, and the second roller 464 moves on the third groove 433. In this state, the staple unit 400 takes the above-described second posture on the F side. Then, at this position, it is possible to perform oblique binding at the corner portion on the F side of the downstream edge portion (trailing edge portion) of the sheet bundle in the second conveyance direction β2.

Side Stitch Binding Position

FIG. 18A illustrates a position where side stitch binding is performed on the F side of the downstream edge portion (trailing edge portion) of the sheet bundle in the second conveyance direction β2. At this position, the first roller 463 and the second roller 464 are located in the first groove 431, and the staple unit 400 is in the first posture. Further, FIG. 18B illustrates a position where the side stitch binding is performed on the R side of the downstream edge portion (trailing edge portion) of the sheet bundle in the second conveyance direction β2. Also at this position, the first roller 463 and the second roller 464 are located in the first groove 431, and the staple unit 400 is in the first posture.

Movement from First Groove to R Side Oblique Binding Position

FIG. 19A illustrates a state in which the first roller 463 and the second roller 464 are located in the first groove 431 and the second roller 464 is located near the downstream end portion of the first groove 431 in the second direction γ2. In this state, the contact portion 455 provided in the stapler moving unit 450 abuts the abutment member 413. When the stapler moving unit 450 moves from this position to the downstream side in the second direction γ2, the contact portion 455 and the abutment member 413 abut on each other, so that the rotation plate 462 starts to rotate in the counter-clockwise direction in the drawing together with the staple unit 400. Then, as illustrated in FIG. 19B, the second roller 464 is engaged with the fourth groove 434.

Next, when the stapler moving unit 450 moves from this position to the downstream side in the second direction γ2, as illustrated in FIG. 19BC, the second roller 464 is engaged with the positioning groove 434*c*, and the first roller 463 is engaged with the fifth groove 435. In this state, the staple unit 400 takes the above-described second posture on the R side. Then, at this position, it is possible to perform oblique binding at the corner portion on the R side of the downstream edge portion (trailing edge portion) of the sheet bundle in the second conveyance direction β2.

According to the present embodiment as described above, it is possible to provide a new configuration for turning the staple unit 400 at the time of performing oblique binding. In particular, in the present embodiment, in order to turn the staple unit 400 on the F side, the abutment member 413 as on the R side is not used. That is, in the present embodiment, the engagement amount of the first roller 463 and the second roller 464 with respect to the groove is made different, and the entry of the first roller 463 is restricted at the entrance of the third groove 433 to guide the first roller 463 to the second groove 432. Therefore, the staple unit 400 can be turned by moving in the width direction without arranging a member serving as a trigger for turning the staple unit 400 outside each groove like the abutment member 413.

Therefore, in the present embodiment, a member that triggers for turning the staple unit 400 on the F side can be omitted. As a result, it is not necessary to dispose such a member outside the groove on the F side, so that the degree of freedom in design can be improved.

By interchanging the configuration of each groove on the F side and the configuration of the groove on the R side and interchanging the positions of the first roller 463 and the second roller 464, the staple unit 400 can be turned in the same manner as described above even if there is no abutment member on the R side.

In the above-described embodiment, the sheet processing apparatus 200A is disposed in the internal space 130 of the image forming apparatus 100, but the configuration of the sheet processing apparatus of the present technology may be, for example, a configuration to be attached to a side surface of the image forming apparatus. Also, the sheet processing apparatus may be controlled by a control unit included in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-117885, filed on Jul. 25, 2022, and Japanese Patent Application No. 2023-113320, filed on Jul. 10, 2023, which are hereby incorporated by reference herein in their entirety.

What is claimed is:

1. A sheet binding apparatus comprising:

a stapler configured to be capable of performing a binding process on a sheet bundle in a first posture and in a second posture which is different from the first posture;

a moving mechanism configured to move the stapler in a moving direction; and a turn mechanism configured to turn the stapler from the first posture to the second posture in accordance with moving the stapler in the moving direction by the moving mechanism, wherein the turn mechanism includes: (1) a first protrusion and a second protrusion configured to move together with the stapler; (2) a first rail configured to guide the first protrusion and the second protrusion in the moving direction; (3) a second rail extending along an inclined direction inclined with respect to the moving direction from a downstream end of the first rail in the moving direction and configured to guide the first protrusion; (4) a third rail extending along the moving direction from the downstream end of the first rail and configured to guide the second protrusion; and (5) an introducing member having a length to introduce the first protrusion from the first rail to the second rail by coming into contact with the first protrusion, and to allow the second protrusion to enter from the first rail to the third rail, wherein when the first protrusion and the second protrusion are guided by the first rail, the stapler is held in the first posture, wherein when (1) the first protrusion is guided by the second rail and (2) the second protrusion is guided by the third rail, the stapler is held in the second posture, and wherein the stapler turns from the first posture to the second posture by (1) the first protrusion being introduced from the first rail to the second rail and (2) the second protrusion being guided from the first rail to the third rail, when the stapler moves in the moving direction.

2. The sheet binding apparatus according to claim 1, further comprising a fourth rail extending along another inclined direction inclined with respect to the inclined direction from a downstream end of the second rail, wherein the stapler turns from the second posture to the first posture by (1) the first protrusion being guided from the second rail to the fourth rail and (2) the second protrusion being guided to a downstream side of the third rail in the moving direction, when the stapler further moves in the moving direction from a position at which (1) the first protrusion is guided by the second rail and (2) the second protrusion is guided by the third rail.

3. An image forming system comprising:

an image forming apparatus including an image forming unit configured to form an image on a sheet; and a sheet binding apparatus configured to perform a binding process on a sheet on which an image is formed by the image forming unit, wherein the sheet binding apparatus includes:

(A) a stapler configured to be capable of performing a binding process on a sheet bundle in a first posture and in a second posture which is different from the first posture;

(B) a moving mechanism configured to move the stapler in a moving direction; and (C) a turn mechanism configured to turn the stapler from the first posture to the second posture in accordance with moving the stapler in the moving direction by the moving mechanism, wherein the turn mechanism includes: (1) a first protrusion and a second protrusion configured to move together with the stapler; (2) a first rail configured to guide the first protrusion and the second protrusion in the moving direction; (3) a second rail extending along an inclined direction inclined with respect to the moving direction from a downstream end of the first rail in the moving direction and configured to guide the first protrusion; (4) a third rail extending along the moving direction from the downstream end of the first rail and configured to guide the second protrusion; and (5) an introducing member having a length to introduce the first protrusion from the first rail to the second rail by coming into contact with the first protrusion, and to allow the second protrusion to enter from the first rail to the third rail, wherein when the first protrusion and the second protrusion are guided by the first rail, the stapler is held in the first posture, wherein when (1) the first protrusion is guided by the second rail and (2) the second protrusion is guided by the third rail, the stapler is held in the second posture, and wherein the stapler turns from the first posture to the second posture by (1) the first protrusion being introduced from the first rail to the second rail and (2) the second protrusion being guided from the first rail to the third rail, when the stapler moves in the moving direction.

* * * * *